US007683866B2

(12) United States Patent
Senda

(10) Patent No.: US 7,683,866 B2
(45) Date of Patent: Mar. 23, 2010

(54) DISPLAY DRIVER FOR REDUCING FLICKERING

(75) Inventor: Michiru Senda, Gifu (JP)

(73) Assignee: Sanyo Electric Co., Ltd., Osaka (JP)

( * ) Notice: Subject to any disclaimer, the term of this patent is extended or adjusted under 35 U.S.C. 154(b) by 1134 days.

(21) Appl. No.: 11/281,926

(22) Filed: Nov. 18, 2005

(65) Prior Publication Data

US 2006/0114208 A1 Jun. 1, 2006

(30) Foreign Application Priority Data

Nov. 22, 2004 (JP) ..... 2004-336890

(51) Int. Cl.
*G09G 3/36* (2006.01)

(52) U.S. Cl. ..... 345/87; 345/90; 345/98; 345/94; 345/100

(58) Field of Classification Search ..... 345/45, 345/55, 58, 87–104, 204, 211, 212; 313/500, 313/504, 505; 349/113, 39, 138, 139, 46; 257/59, 72

See application file for complete search history.

(56) References Cited

U.S. PATENT DOCUMENTS

| | | | | |
|---|---|---|---|---|
| 4,320,302 | A * | 3/1982 | Stein | 250/201.8 |
| 4,412,741 | A * | 11/1983 | Stein | 356/3.08 |
| 6,404,414 | B2 * | 6/2002 | Ishii | 345/90 |
| 6,778,162 | B2 * | 8/2004 | Kimura et al. | 345/90 |
| 6,909,413 | B2 * | 6/2005 | Nanno et al. | 345/87 |
| 7,084,842 | B2 * | 8/2006 | Kim et al. | 345/87 |
| 7,098,885 | B2 * | 8/2006 | Kumada et al. | 345/96 |
| 7,532,189 | B2 * | 5/2009 | Hirosawa | 345/98 |
| 2001/0033264 | A1 * | 10/2001 | Ishii | 345/92 |
| 2002/0084969 | A1 * | 7/2002 | Ozawa | 345/96 |
| 2003/0156079 | A1 * | 8/2003 | Nakanishi | 345/45 |
| 2003/0206149 | A1 * | 11/2003 | Yamashita et al. | 345/92 |
| 2004/0125066 | A1 * | 7/2004 | Park et al. | 345/92 |
| 2005/0001807 | A1 * | 1/2005 | Lee et al. | 345/92 |
| 2005/0110734 | A1 * | 5/2005 | Hirosawa | 345/87 |
| 2006/0071893 | A1 * | 4/2006 | Nishina et al. | 345/89 |
| 2006/0221043 | A1 * | 10/2006 | Horibata et al. | 345/100 |
| 2006/0233007 | A1 * | 10/2006 | Horibata et al. | 365/1 |
| 2007/0164956 | A1 * | 7/2007 | Araki et al. | 345/90 |

FOREIGN PATENT DOCUMENTS

JP 2003216126 * 7/2003

OTHER PUBLICATIONS

Suzuki; "Introduction of Liquid Crystal Display Engineering"; *The Daily Industrial News*; c. 1998; pp. 101-103.

* cited by examiner

*Primary Examiner*—Prabodh M Dharia
(74) *Attorney, Agent, or Firm*—McDermott Will & Emery LLP

(57) ABSTRACT

A display capable of rendering flickering hard to visually recognize and reducing power consumption is obtained. This display comprises first and second pixel portions including subsidiary capacitors having first electrodes connected to pixel electrodes and second electrodes respectively, first and second subsidiary capacitance lines connected to the second electrodes of the first and second pixel portions respectively and a signal supply circuit supplying first and second signals having first and second voltages to the first and second subsidiary capacitance lines respectively.

16 Claims, 9 Drawing Sheets

DISPLAY DRIVER FOR REDUCING FLICKERING

BACKGROUND OF THE INVENTION

Field of the Invention

The present invention relates to a display, and more particularly, it relates to a display having a pixel portion.

CROSS-REFERENCE TO RELATED APPLICATIONS

The priority application number JP2004-336890 upon which this patent application is based is hereby incorporated by reference.

DESCRIPTION OF THE BACKGROUND ART

A liquid crystal display comprising a pixel portion including a liquid crystal layer is generally known as a display. In the conventional liquid crystal display, the liquid crystal layer of the pixel portion is held between a pixel electrode and a common electrode. The conventional liquid crystal display changes the arrangement of liquid crystal molecules by controlling a voltage (video signal) applied to the pixel electrode of the pixel portion, thereby displaying an image responsive to the video signal on a display portion.

When the aforementioned liquid crystal display applies a dc voltage to the liquid crystal layer (pixel electrode) of the pixel portion over a long period, an afterimage phenomenon referred to as burn-in takes place. Therefore, the liquid crystal display must be driven by a method of inverting the voltage (pixel voltage) of the pixel electrode with respect to that of the common electrode in a prescribed cycle. For example, the liquid crystal display is driven by a DC driving method applying a dc voltage to the common electrode. Line inversion driving inverting the polarity of the pixel voltage with respect to the common electrode in contact with the applied dc voltage every horizontal period is known as such a DC driving method, as disclosed in "Introduction to Liquid Crystal Display Engineering" by Yasoji Suzuki, The Daily Industrial News, Nov. 20, 1998, pp. 101-103. The liquid crystal display completes the operation of writing the video signal in all pixel portions arranged along a gate line every horizontal period.

FIG. 10 is a waveform diagram in a case of driving a liquid crystal display by the conventional line inversion driving method. Referring to FIG. 10, the polarity of a video signal (VIDEO) is inverted with respect to the voltage of a common electrode (COM) every horizontal period, in order to drive the liquid crystal display by the conventional line inversion driving method. The video signal (VIDEO) is varied with a displayed image every pixel portions A to F.

When the liquid crystal display is driven by the conventional line inversion driving method shown in FIG. 10 at a low frequency in order to reduce power consumption, however, flickering is disadvantageously easy to visually recognize. More specifically, a period for holding the pixel voltage is increased when the liquid crystal display is driven at a low frequency, to remarkably fluctuate the pixel voltage. When the pixel voltage is remarkably fluctuated, the brightness of light passing through the pixel portions A to F deviates from a desired level, to cause flickering. In the conventional line inversion driving method, therefore, the aforementioned flickering linearly takes place to easily allow visual recognition.

In this regard, a liquid crystal display employing a dot inversion driving method of inverting the polarity of a pixel voltage video signal (VIDEO) with respect to the voltage of a common electrode (COM) every adjacent pixel portions A and B, B and C, C and D, D and E or E and F is proposed in general.

FIG. 11 is a waveform diagram in a case of driving a liquid crystal display by a conventional dot inversion driving method. Referring to FIG. 11, the polarity of a video signal (VIDEO) responsive to a displayed image is inverted with respect to the voltage of a common electrode (COM) every pixel portion A, B, C, D, E or F in order to drive the liquid crystal display by the conventional dot inversion driving method, dissimilarly to the conventional line inversion driving method shown in FIG. 10. When the liquid crystal display is driven by this conventional dot inversion driving method, flickering caused by low-frequency driving can be rendered hard to visually recognize since this flickering nonlinearly takes place.

However, the conventional dot inversion driving method shown in FIG. 11 requires a video signal having a voltage twice a liquid crystal driving voltage, in order to invert the polarity of the video signal (VIDEO) with respect to the voltage of the common electrode (COM) receiving a dc voltage. Assuming that V1 represents the liquid crystal driving voltage in FIG. 11, for example, a video signal having a voltage V2 twice the liquid crystal driving voltage V1 is required in order to obtain the same liquid crystal driving voltage V1 before and after inverting the polarity of the video signal (VIDEO) with respect to the voltage of the common electrode (COM). Therefore, reduction of power consumption is disadvantageously limited also when the liquid crystal display is driven at a low frequency in order to reduce power consumption.

SUMMARY OF THE INVENTION

The present invention has been proposed in order to solve the aforementioned problem, and an object of the present invention is to provide a display capable of rendering flickering hard to visually recognize and reducing power consumption.

In order to attain the aforementioned object, a display according to an aspect of the present invention comprises a plurality of drain lines and a plurality of gate lines arranged to intersect with each other, a first pixel portion and a second pixel portion including subsidiary capacitors having first electrodes connected to pixel electrodes and second electrodes respectively, a first subsidiary capacitance line and a second subsidiary capacitance line connected to the second electrodes of the subsidiary capacitors of the first pixel portion and the second pixel portion respectively, a gate line driving circuit including a shift register for sequentially driving the plurality of gate lines and consisting of a plurality of transistors of the same conductive type and a signal supply circuit supplying a first signal having a first voltage and a second signal having a second voltage to the first subsidiary capacitance line of the first pixel portion and the second subsidiary capacitance line of the second pixel portion respectively and including a plurality of signal supply circuit portions each formed by a plurality of transistors of the same conductive type as the transistors constituting the gate line driving circuit.

The display according to this aspect, provided with the signal supply circuit for supplying the first and second signals having the first and second voltages to the first and second subsidiary capacitance lines of the first and second pixel portions respectively as hereinabove described, can raise the voltage of the subsidiary capacitor of the first pixel portion to a high level by supplying the first signal of positive polarity to the second electrode of the subsidiary capacitor of the first pixel portion through the first subsidiary capacitance line assuming that the first and second voltages are at high and low levels (positive polarity and negative polarity) respectively and the first and second signals are supplied to the first and second subsidiary capacitance lines of the first and second pixel portions respectively, for example. Further, the display can drop the voltage of the subsidiary capacitor of the second pixel portion to a low level by supplying the second signal of negative polarity to the second electrode of the subsidiary capacitor of the second pixel portion through the second subsidiary capacitance line. Thus, the display can render the voltage of the pixel electrode of the first pixel portion higher than a state immediately after writing a high-level video signal in the first pixel portion by supplying the first signal of positive polarity to the second electrode of the subsidiary capacitor of the first pixel portion after writing the video signal. Further, the display can render the pixel voltage of the second pixel portion lower than a state immediately after writing a low-level video signal in the second pixel portion by supplying the second signal of negative polarity to the second electrode of the subsidiary capacitor of the second pixel portion after writing the video signal. Thus, the dynamic ranges of the video signals may not be enlarged, whereby the display can inhibit power consumption from increase resulting from enlarged dynamic ranges of the video signals. Further, the display can easily perform dot inversion driving of inverting the pixel voltage (video signal) with respect to the voltage of a common electrode every adjacent pixel portions by adjacently arranging the first and second pixel portions. In addition, the display can easily perform block inversion driving of inverting the pixel voltage (video signal) with respect to the voltage of the common electrode every plurality of pixel portions by constituting a block of only a plurality of first pixel portions, constituting another block of only a plurality of second pixel portions and adjacently arranging these blocks. Thus, no flickering linearly takes place when the display performs dot inversion driving or block inversion driving dissimilarly to a case of performing line inversion driving of inverting a pixel voltage (video signal) with respect to the voltage of a common electrode every adjacent gate lines, whereby the display can render flickering hard to visually recognize. When the gate line driving circuit is constituted of a plurality of transistors of the same conductive type and the signal supply circuit is constituted of a plurality of transistors of the same conductive type as those constituting the gate line driving circuit, it is possible to inhibit the numbers of ion implantation steps and ion implantation masks from increase when forming the plurality of transistors constituting the gate line driving circuit and the plurality of transistor constituting the signal supply circuit. Thus, complication of the manufacturing process as well as increase of the manufacturing cost can be suppressed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention are now described with reference to the drawings.

First Embodiment

Figure 1:
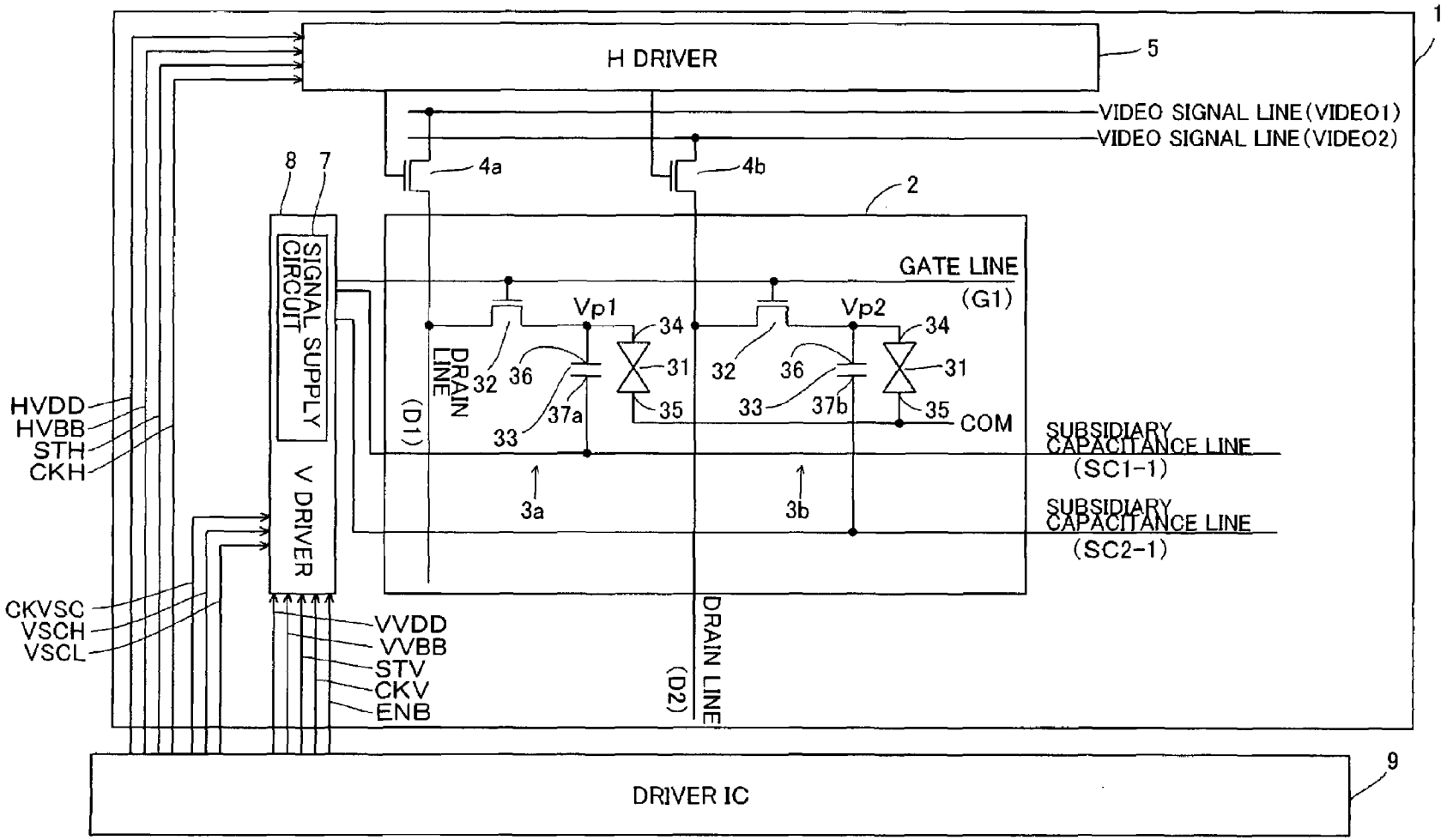
FIG. 1 is a plan view showing a liquid crystal display according to a first embodiment of the present invention.

Referring to FIG. 1, a display portion 2 is provided on a substrate 1 in a liquid crystal display according to a first embodiment of the present invention. Pixel portions 3*a* and 3*b* are arranged on the display portion 2. While FIG. 1 shows a first-stage gate line (G1) and two drain lines (D1 and D2) intersecting with the first-stage gate line (G1) and only single pixel portions 3*a* and 3*b* arranged along the first-stage gate line (G1) for simplifying the illustration, a plurality of gate lines and a plurality of drain lines are arranged to intersect with each other and a plurality of sets of pixel portions 3*a* and 3*b* are adjacently arranged in the form of a matrix in practice. The pixel portions 3*a* and 3*b* are examples of the "first pixel portion" and the "second pixel portion" in the present invention respectively.

Each of the pixel portions 3*a* and 3*b* is constituted of a liquid crystal layer 31, an n-channel transistor 32 (hereinafter referred to as a transistor 32) and a subsidiary capacitor 33. The liquid crystal layer 31 of each of the pixel portions 3*a* and 3*b* is connected between a pixel electrode 34 and a common electrode 35. The drains of the transistors 32 of the pixel portions 3*a* and 3*b* are connected to the drain lines (D1 and D2) respectively. The sources of the transistors 32 of the pixel portions 3*a* and 3*b* are connected to the pixel electrodes 34 respectively. First electrodes 36 of the subsidiary capacitors 33 of the pixel portions 3*a* and 3*b* are connected to the pixel electrodes 34 respectively.

According to the first embodiment, second electrodes 37*a* and 37*b* of the subsidiary capacitors 33 of the pixel portions 3*a* and 3*b* are connected to subsidiary capacitance lines (SC1-1 and SC2-1) respectively. While FIG. 1 shows only the pair of subsidiary capacitance lines (SC1-1 and SC2-1) connected with the pixel portions 3*a* and 3*b* respectively, pairs of subsidiary capacitance lines are provided stage by stage with respect to a plurality of stages of gate lines respectively in practice. Further, pairs of subsidiary capacitance lines corresponding to each stage are alternately connected to the plurality of sets of pixel portions 3*a* and 3*b* arranged along each stage gate line. The electrodes 36 are examples of the "first electrode" in the present invention, and the electrodes 37*a* and 37*b* are examples of the "second electrode" in the present invention. The subsidiary capacitance line (SC1-1) connected with the pixel portion 3*a* is an example of the "first subsidiary capacitance line" in the present invention, and the subsidiary capacitance line (SC2-1) connected with the pixel portion 3*b* is an example of the "second subsidiary capacitance line" in the present invention.

The substrate 1 is provided thereon with n-channel transistors (H switches) 4*a* and 4*b* (hereinafter referred to as transistors 4*a* and 4*b*) for driving (scanning) the drain lines and an H driver 5 formed by a plurality of n-channel transistors (not shown). The transistors 4*a* and 4*b* corresponding to the pixel portions 3*a* and 3*b* are connected to video signal lines (VIDEO1 and VIDEO2) respectively. Video signals VIDEO1 and VIDEO2 have waveforms exhibiting inverted black and white voltages.

Figure 2:
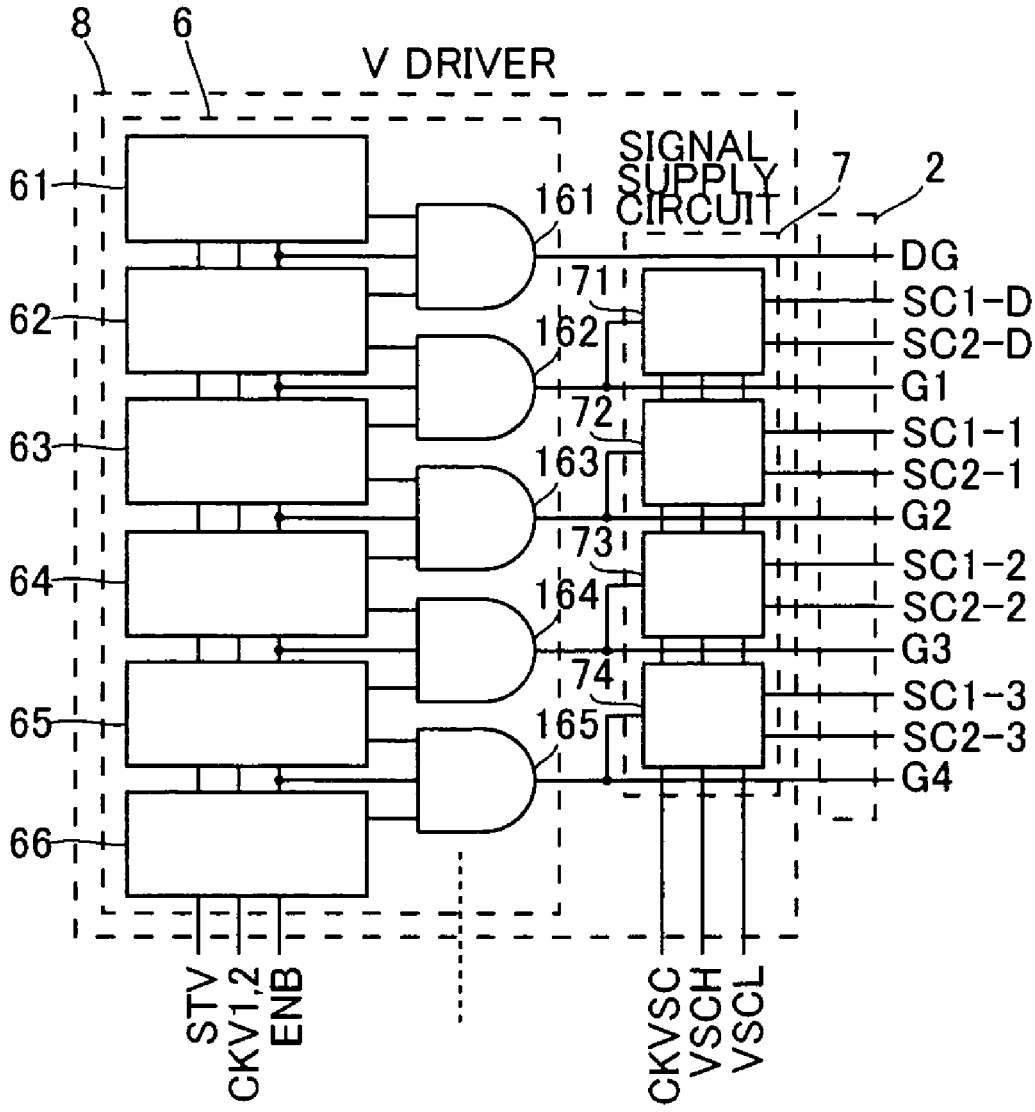
FIG. 2 is a block diagram of a V driver of the liquid crystal display according to the first embodiment shown in FIG. 1.

According to the first embodiment, a V driver 8 including a gate line driving circuit 6 and a signal supply circuit 7 is provided on the substrate 1, as shown in FIGS. 1 and 2. The gate line driving circuit 6 of the V driver 8 has a function of driving (scanning) the plurality of stages of gate lines. The signal supply circuit 7 has a function of alternately supplying a high voltage VSCH of positive polarity and a low voltage VSCL of negative polarity to a plurality of stages of pairs of subsidiary capacitance lines every frame period. The liquid crystal display completes the operation of writing the video signals VIDEO1 and VIDEO2 in all pixel portions 3*a* and 3*b* constituting the display portion 2 every frame period.

A driver IC 9 is set outside the substrate 1, as shown in FIG. 1. This driver IC 9 supplies the H driver 5 with a higher voltage HVDD, a lower voltage HVBB, a start signal STH and a clock signal CKH. The driver IC 9 also supplies the V driver 8 with a higher voltage VVDD, a lower voltage VVBB, a start signal STV, a clock signal CKV, an enable signal ENB, the high voltage VSCH, the low voltage VSCL and a clock signal CKVSC. The clock signal CKV is input in the gate line driving circuit 6 (see FIG. 2) of the V driver 8, for switching higher and lower voltages VDD and VBB in a prescribed cycle in one frame period. On the other hand, the clock signal CKVSC is input in the signal supply circuit 7 of the V driver 8, for switching the higher and lower voltages VDD and VBB every frame period.

Figure 3:
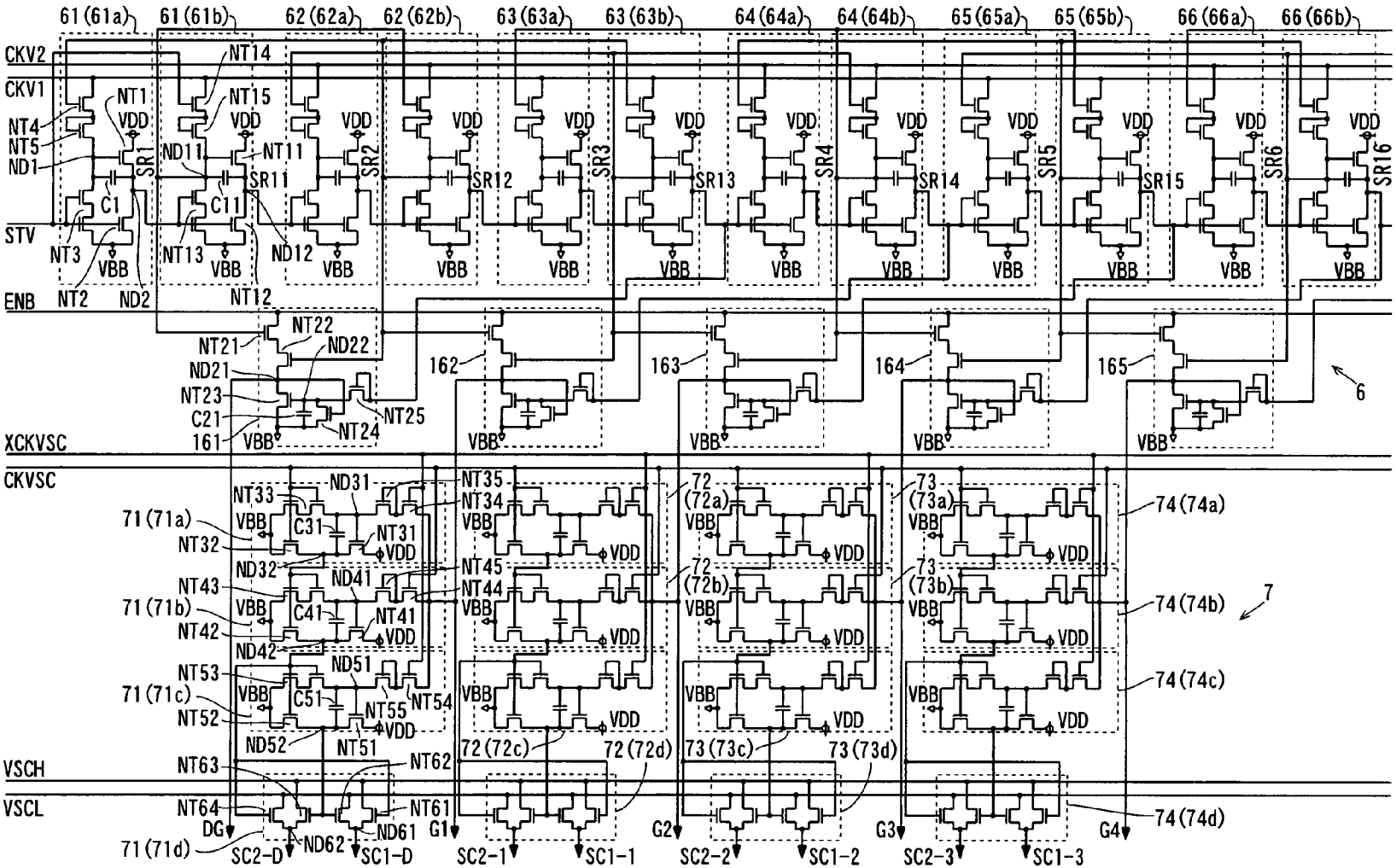
FIG. 3 is a circuit diagram in the V driver of the liquid crystal display according to the first embodiment shown in FIG. 1.

The internal structure of the V driver 8 is now described with reference to FIG. 3. The gate line driving circuit 6 includes a plurality of stages of shift register circuit portions 61 to 66 and a plurality of stages of logic composition circuit portions 161 to 165. While FIG. 3 shows only six stages of shift register circuit portions 61 to 66 and five stages of logic composition circuit portions 161 to 165 for simplifying the illustration, shift register circuit portions and logic composition circuit portions are provided in numbers responsive to the pixel number in practice.

The first-stage shift register circuit portion 61 is constituted of first and second circuit portions 61*a* and 61*b*. The first circuit portion 61*a* of the first-stage shift register circuit portion 61 includes n-channel transistors NT1, NT2, NT3 and NT4, a diode-connected n-channel transistor NT5 and a capacitor C1. The n-channel transistors NT1 to NT5 are hereinafter referred to as transistors NT1 to NT5 respectively.

According to the first embodiment, all of the transistors NT1 to NT5 provided on the first circuit portion 61*a* are constituted of TFTs (thin-film transistors) formed by n-type MOS transistors (field-effect transistors).

In the first circuit portion 61*a* of the first-stage shift register circuit portion 61, the source and the drain of the transistor NT1 are connected to a node ND2 and the higher voltage VDD respectively. The gate of this transistor NT1 is connected to another node ND1. The capacitor C1 is connected between the gate and the source of the transistor NT1. The source and the drain of the transistor NT2 are connected to the lower voltage VBB and the node ND2 respectively. This transistor NT2 receives the start signal STV in its gate.

The transistor NT3 is connected between the gate of the transistor NT1 and the lower voltage VBB. This transistor NT3 receives the start signal STV in its gate, similarly to the transistor NT2. The transistor NT3 has two gate electrodes electrically connected with each other. This transistor NT3 has a function of turning off the transistor NT1 when the transistor NT2 is in an ON-state.

The transistor NT4 is connected between the gate of the transistor NT1 and a clock signal line (CKV1). More specifically, the source of the transistor NT4 is connected to the node ND1 through the diode-connected transistor NT5, while the drain thereof is connected to the clock signal line (CKV1). This transistor NT4 receives a shift signal SR2 from the second-stage shift register circuit 62 in its gate.

The second circuit portion 61*b* of the first-stage shift register circuit portion 61 includes n-channel transistors NT11, NT12, NT13 and NT14, a diode-connected transistor NT15 and a capacitor C11. The n-channel transistors NT11 to NT15 are hereinafter referred to as transistors NT11 to NT15 respectively.

According to the first embodiment, all of the transistors NT11 to NT15 provided on the second circuit portion 61*b* are constituted of TFTs formed by n-type MOS transistors.

In the second circuit portion 61*b* of the first-stage shift register circuit portion 61, the source and the drain of the transistor NT11 are connected to a node ND12 and the higher voltage VDD respectively. The gate of this transistor NT11 is connected to another node ND11. The capacitor C11 is connected between the gate and the source of the transistor NT11. The source and the drain of the transistor NT12 are connected to the lower voltage VBB and the node ND12 respectively. The gate of this transistor NT12 is connected to the node ND2 of the first circuit portion 61*a*.

The transistor NT13 is connected between the gate of the transistor NT11 and the lower voltage VBB. The gate of this transistor NT13 is connected to the node ND2 of the first circuit portion 61*a*, similarly to that of the transistor NT12. The transistor NT13 has two gate electrodes electrically connected with each other. This transistor NT13 has a function of turning off the transistor NT11 when the transistor NT12 is in an ON-state.

The transistor NT14 is connected between the gate of the transistor NT11 and the clock signal line (CKV1). More specifically, the source of the transistor NT14 is connected to the node ND11 through the diode-connected transistor NT15, and the drain thereof is connected to the clock signal line (CKV1). This transistor NT14 receives the start signal STV in its gate.

The second- to sixth-stage shift register circuit portions 62 to 66 have circuit structures similar to that of the aforementioned first-stage shift register circuit portion 61. In other words, the second- to sixth-stage shift register circuit portions 62 to 66 are constituted of first circuit portions 62*a* to 66*a* having circuit structures similar to that of the first circuit portion 61*a* of the first-stage shift register circuit portion 61 and second circuit portions 62*b* to 66*b* having circuit structures similar to that of the second circuit portion 61*b* of the first-stage shift register circuit portion 61 respectively. Seventh-stage and subsequent shift register circuit portions (not shown) also have circuit structures similar to that of the aforementioned first-stage shift register circuit portion 61.

In each of the second-stage and subsequent shift register circuit portions, the transistors NT2 and NT3 of the prescribed stage of the shift register circuit portion receive a shift output signal from the precedent shift register circuit portion in the gates thereof. Further, the transistor NT4 of the prescribed stage of the shift register circuit portion receives a shift signal from the subsequent shift register circuit portion in its gate, while the transistor NT14 of the prescribed stage of the shift register circuit portion receives a shift signal from the precedent shift register circuit portion in its gate. The first- to sixth-stage shift register circuit portions 61 to 66 output shift signals SR1 to SR6 from the nodes ND11 thereof respectively, and output shift output signals SR11 to SR16 from the nodes ND12 thereof respectively.

The drains of the transistors NT4 and NT14 of the second-, fourth- and sixth-stage shift register circuit portions 62, 64 and 66 are connected to another clock signal line (CKV2). On the other hand, the drains of the transistors NT4 and NT14 of the third- and fifth-stage shift register circuit portions 63 and 65 are connected to the clock signal line (CKV1), similarly to the transistors NT4 and NT14 of the first-stage shift register circuit portion 61. In other words, the plurality of stages of shift register circuit portions are alternately connected with the clock signal lines (CKV1 and CKV2).

The logic composition circuit portions 161 to 165 are connected to a dummy gate line (DG) and first- to fourth-stage gate lines (G1 to G4) respectively.

The logic composition circuit 161 connected to the dummy gate line (DG) includes n-channel transistors NT21, NT22, NT23 and NT24, a diode-connected n-channel transistor NT25 and a capacitor C21. The n-channel transistors NT21 to NT25 are hereinafter referred to as transistors NT21 to NT25 respectively.

According to the first embodiment, all of the transistors NT21 to NT25 provided on the logic composition circuit 161 are constituted of TFTs formed by n-type MOS transistors.

In the logic composition circuit portion 161 connected to the dummy gate line (DG), the drain and the source of the transistor NT21 are connected to an enable signal line (ENB) and the drain of the transistor NT22 respectively. The source of the transistor NT22 is connected to a node ND21 (dummy gate line). The transistors NT21 and NT22 receive the shift signals SR1 and SR2 from the first- and second-stage shift register circuit portions 61 and 62 in the gates thereof respectively.

The source and the drain of the transistor NT23 are connected to the lower voltage VBB and the node ND21 (dummy gate line) respectively. This transistor NT23 receives the shift output signal SR13 from the third-stage shift register circuit 63 in its gate through the diode-connected transistor NT25. The source and the drain of the transistor NT24 are connected to the lower voltage VBB and a node ND22 (gate of the transistor NT23) respectively. The gate of this transistor NT24 is connected to the node ND21. First and second electrodes of the capacitor C21 are connected to the lower voltage VBB and the node ND22 (gate of the transistor NT23) respectively.

The logic composition circuit portions 162 to 165 connected to the first- to fourth-stage gate lines (G1 to G4) respectively have circuit structures similar to that of the logic composition circuit portion 161 connected to the aforementioned dummy gate line (DG). The first- to fourth-stage gate lines (G1 to G4) are connected to the sources of the transistors NT22 and the drains of the transistors NT23 of the logic composition circuit portions 162 to 165 respectively. Logic composition circuit portions (not shown) connected to fifth-stage and subsequent gate lines (not shown) also have circuit structures similar to that of the logic composition circuit portion 161 connected to the aforementioned dummy gate line (DG).

In the logic composition circuit portion 162 connected to the first-stage gate line (G1), the transistors NT21 and NT22 receive the shift signals SR2 and SR3 from the second- and third-stage shift register circuit portions 62 and 63 in the gates thereof respectively. In the logic composition circuit portion 163 connected to the second-stage gate line (G2), the transistors NT21 and NT22 receive the shift signals SR3 and SR4 from the third- and fourth-stage shift register circuit portions 63 and 64 in the gates thereof respectively. Thus, the transistors NT21 and NT22 of each logic composition circuit portion connected to the prescribed stage of gate line receive the shift signals from the shift register circuit portions adjacent thereto respectively. Further, the shift signal input in the transistor NT21 of the logic composition circuit portion connected to a prescribed stage of gate line and that input in the transistor NT22 of the logic composition circuit portion connected to the precedent gate line overlap with each other, while the shift signal input in the transistor NT22 of the logic composition circuit portion connected to the prescribed stage of gate line and that input in the transistor NT21 of the logic composition circuit portion connected to the subsequent gate line overlap with each other.

The transistor NT23 of the logic composition circuit portion 162 connected to the first-stage gate line (G1) receives the shift output signal SR14 from the fourth-stage shift register circuit portion 64 in its gate, while the transistor NT23 of the logic composition circuit portion 163 connected to the second-stage gate line (G2) receives the shift output signal SR15 from the fifth-stage shift register circuit portion 65 in its gate. The logic composition circuit portions connected to the third-stage and subsequent gate lines receive the shift output signals from the sixth-stage and subsequent shift register circuit portions in the gates thereof respectively.

The signal supply circuit 7 of the V driver 8 includes a plurality of stages of signal supply circuit portions 71 to 74. The signal supply circuit portion 71 is connected to dummy subsidiary capacitance lines (SC1-D and SC2-D). The signal supply circuit portions 72 and 73 are connected to the first-stage subsidiary capacitance lines (SC1-1 and SC2-1) and the second-stage subsidiary capacitance lines (SC1-2 and SC2-2) respectively. The signal supply circuit portion 74 is connected to the third-stage subsidiary capacitance lines (SC1-3 and SC2-3). While FIG. 3 shows only four stages of signal supply circuit portions 71 to 74 for simplifying the illustration, the signal supply circuit portions are provided in the same number as the plurality of gate lines including the dummy gate lines in practice.

The signal supply circuit portion 71 connected to the dummy subsidiary capacitance lines (SC1-D and SC2-D) is constituted of a first signal generation circuit portion 71*a*, a second signal generation circuit portion 71*b*, a third signal generation circuit portion 71*c* and a signal switching circuit portion 71*d*. The first signal generation circuit portion 71*a* of the signal supply circuit portion 71 connected to the dummy subsidiary capacitance lines (SC1-D and SC2-D) includes n-channel transistors NT31, NT32, NT33 and NT34, a diode-connected n-channel transistor NT35 and a capacitor C31. The n-channel transistors NT31, NT32, NT33 and NT34 are examples of the "fifth transistor", the "sixth transistor", the "seventh transistor" and the "eighth transistor" in the present invention respectively, and the n-channel transistor NT35 is an example of the "diode" in the present invention. The n-channel transistors NT31 to NT35 are hereinafter referred to as transistor NT31 to NT35 respectively.

According to the first embodiment, all of the transistors NT31 to NT35 provided on the first signal generation circuit portion 71*a* are constituted of TFTs formed by n-type MOS transistors.

In the first signal generation circuit portion 71*a* of the signal supply circuit portion 71 connected to the dummy subsidiary capacitance lines (SC1-D and SC2-D), the source and the drain of the transistor NT31 are connected to a node ND32 and the higher voltage VDD respectively. The gate of this transistor NT31 is connected to another node ND31. The source and the drain of the transistor NT32 are connected to the lower voltage VBB and the node ND32 respectively. This transistor NT32 receives the clock signal CKVSC in its gate.

According to the first embodiment, the transistor NT33 is connected between the gate of the transistor NT31 and the lower voltage VBB. In other words, the source and the drain of the transistor NT33 are connected to the lower voltage VBB and the node ND31 respectively. This transistor NT33 receives the clock signal CKVSC in its gate, similarly to the transistor NT32. The transistor NT33 has two gate electrodes electrically connected with each other. This transistor NT33 has a function of turning off the transistor NT31 when the transistor NT32 is in an ON-state.

According to the first embodiment, the transistor NT34 is connected between the gate of the transistor NT31 and the first-stage gate line (G1). More specifically, the source of the transistor NT34 is connected to the node ND31 through the diode-connected transistor NT35, and the drain thereof is connected to the first-stage gate line (G1). This transistor NT34 receives an inverted clock signal XCKVSC in its gate.

According to the first embodiment, the capacitor C31 is connected between the gate and the source of the transistor NT31.

The second signal generation circuit portion 71*b* of the signal supply circuit portion 71 connected to the dummy subsidiary capacitance lines (SC1-D and SC2-D) includes n-channel transistors NT41, NT42, NT43 and NT44, a diode-connected n-channel transistor NT45 and a capacitor C41. The n-channel transistors NT41, NT42, NT43 and NT44 are examples of the "fifth transistor", the "sixth transistor", the "seventh transistor" and the "eighth transistor" in the present invention respectively, and the n-channel transistor NT45 is an example of the "diode" in the present invention. The n-channel transistors NT41 to NT45 are hereinafter referred to as transistors NT41 to NT45 respectively.

According to the first embodiment, all of the transistors NT41 to NT45 provided on the second signal generation circuit portion 71*b* are constituted of TFTs formed by n-type MOS transistors.

In the second signal generation circuit portion 71*b* of the signal supply circuit portion 71 connected to the dummy subsidiary capacitance lines (SC1-D and SC2-D), the source and the drain of the transistor NT41 are connected to a node ND42 and the higher voltage VDD respectively. The gate of this transistor NT41 is connected to another node ND41. The source and the drain of the transistor NT42 are connected to the lower voltage VBB and the node ND42 respectively. The gate of this transistor NT42 is connected to the node ND32 of the first signal generation circuit portion 71*a*.

According to the first embodiment, the transistor NT43 is connected between the gate of the transistor NT41 and the lower voltage VBB. In other words, the source and the drain of the transistor NT43 are connected to the lower voltage VBB and the node ND41 respectively. The gate of this transistor NT43 is connected to the node ND32 of the first signal generation circuit portion 71*a*, similarly to that of the transistor NT42. The transistor NT43 has two gate electrodes electrically connected with each other. This transistor NT43 has a function of turning off the transistor NT41 when the transistor NT42 is in an ON-state.

According to the first embodiment, the transistor NT44 is connected between the gate of the transistor NT41 and the first-stage gate line (G1). More specifically, the source of the transistor NT44 is connected to the node ND41 through the diode-connected transistor NT45, and the drain thereof is connected to the first-stage gate line (G1). This transistor NT44 receives the clock signal CKVSC in its gate, dissimilarly to the transistor NT34 of the first signal generation circuit portion 71*a*.

According to the first embodiment, the capacitor C41 is connected between the gate and the source of the transistor NT41.

The third signal generation circuit portion 71*c* of the signal supply circuit portion 71 connected to the dummy subsidiary capacitance lines (SC1-D and SC2-D) includes n-channel transistors NT51, NT52, NT53 and NT54, a diode-connected n-channel transistor NT55 and a capacitor C51. The n-channel transistors NT51, NT52, NT53 and NT54 are examples of the "fifth transistor", the "sixth transistor", the "seventh transistor" and the "eighth transistor" in the present invention respectively, and the n-channel transistor NT55 is an example of the "diode" in the present invention. The n-channel transistors NT51 to NT55 are hereinafter referred to transistors NT51 to NT55 respectively.

According to the first embodiment, all of the transistors NT51 to NT55 provided on the third signal generation circuit portion 71*c* are constituted of TFTs formed by n-type MOS transistors.

In the third signal generation circuit portion 71*c* of the signal supply circuit portion 71 connected to the dummy subsidiary capacitance lines (SC1-D and SC2-D), the source and the drain of the transistor NT51 are connected to a node ND52 and the higher voltage VDD respectively. The gate of this transistor NT51 is connected to another node ND51. The source and the drain of the transistor NT52 are connected to the lower voltage VBB and the node ND52 respectively. The gate of this transistor NT52 is connected to the node ND42 of the second signal generation circuit portion 71*b*.

According to the first embodiment, the transistor NT53 is connected between the gate of the transistor NT51 and the lower voltage VBB. In other words, the source and the drain of the transistor NT53 are connected to the lower voltage VBB and the node ND51 respectively. The gate of this transistor NT53 is connected to the node ND42 of the second signal generation circuit portion 71*b*, similarly to that of the transistor NT52. The transistor NT53 has two gate electrodes electrically connected with each other. This transistor NT53 has a function of turning off the transistor NT51 when the transistor NT52 is in an ON-state.

According to the first embodiment, the transistor NT54 is connected between the gate of the transistor NT51 and the first-stage gate line (G1). More specifically, the source of the transistor NT54 is connected to the node ND51 through the diode-connected transistor NT55, and the drain thereof is connected to the first-stage gate line (G1). This transistor NT54 receives the inverted clock signal XCKVSC in its gate, similarly to the transistor NT34 of the first signal generation circuit portion 71*a*.

According to the first embodiment, the capacitor C51 is connected between the gate and the source of the transistor NT51.

The signal switching circuit portion 71*d* of the signal supply circuit portion 71 connected to the dummy subsidiary capacitance lines (SC1-D and SC2-D) includes n-channel transistors NT61, NT62, NT63 and NT64. The n-channel transistors NT61, NT62, NT63 and NT64 are examples of the "first transistor", the "second transistor", the "third transistor" and the "fourth transistor" in the present invention respectively. The n-channel transistors NT61 to NT64 are hereinafter referred to as transistors NT61 to NT64 respectively.

According to the first embodiment, all of the transistors NT61 to NT64 provided on the signal switching circuit portion 71*d* are constituted of TFTs formed by n-type MOS transistors.

According to the first embodiment, the sources of the transistors NT61 and NT62 are connected to a node ND61 (dummy subsidiary capacitance line (SC1-D)) in the signal switching circuit portion 71*d* of the signal supply circuit portion 71 connected to the dummy subsidiary capacitance lines (SC1-D and SC2-D). The transistors NT61 and NT62 are supplied with the high voltage VSCH of positive polarity and the low voltage VSCH of negative polarity in the drains thereof respectively. The transistors NT61 and NT62 receive signals from the nodes ND42 and ND52 of the second and third signal generation circuit portions 71*b* and 71*c* in the gates thereof respectively.

The sources of the transistors NT63 and NT64 are connected to a node ND62 (dummy subsidiary capacitance line (SC2-D)). The transistors NT63 and NT64 are supplied with the high and low voltages VSCH and VSCL of positive polarity and negative polarity in the drains thereof respectively. The transistors NT63 and NT64 receive signals from the nodes ND52 and ND42 of the third and second signal generation circuit portions 71*c* and 71*b* in the gates thereof respectively.

The signal supply circuit portions 72 to 74 connected to the first- to third-stage subsidiary capacitance lines (SC1-1 to SC1-3) and (SC2-1 to SC2-3) have circuit structures similar to that of the aforementioned signal supply circuit portion 71 connected to the dummy subsidiary capacitance lines (SC1-D and SC2-D) respectively. In other words, the signal supply circuit portions 72 to 74 connected to the first- to third-stage subsidiary capacitance lines (SC1-1 to SC1-3) and subsidiary capacitance lines (SC2-1 to SC2-3) are constituted of first signal generation circuit portions 72*a* to 74*a*, second signal generation circuit portions 72*b* to 74*b*, third signal generation circuit portions 72*c* to 74*c* and signal switching circuit portions 72*d* to 74*d* having circuit structures similar to the circuit structures of those of the signal supply circuit portion 71 connected to the dummy subsidiary capacitance lines (SC1-D and SC2-D) respectively. The first- to third-stage subsidiary capacitance lines (SC1-1 to SC1-3) are connected to the sources of transistors NT61 and NT62 of the signal switching circuits 72*d* to 74*d* of the signal supply circuit portions 72 to 74 respectively. The first- to third-stage subsidiary capacitance lines (SC2-1 to SC2-3) are connected to the sources of transistors NT63 and NT64 of the signal switching circuit portions 72*d* to 74*d* of the signal supply circuit portions 72 to 74 respectively.

Signal supply circuit portions (not shown) connected to fifth-stage and subsequent pairs of subsidiary capacitance lines (not shown) also have circuit structures similar to that of the aforementioned signal supply circuit portion 71 connected to the dummy subsidiary capacitance lines (SC1-D and SC2-D). Each signal supply circuit portion connected to a prescribed stage of pair of subsidiary capacitance lines is arranged in correspondence to a prescribed stage of gate line, while the drains of transistors NT34, NT44 and NT45 of first to third signal generation circuit portions of the signal supply circuit portion connected to the prescribed stage of pair of subsidiary capacitance lines are connected to the subsequent gate line.

Figure 4:
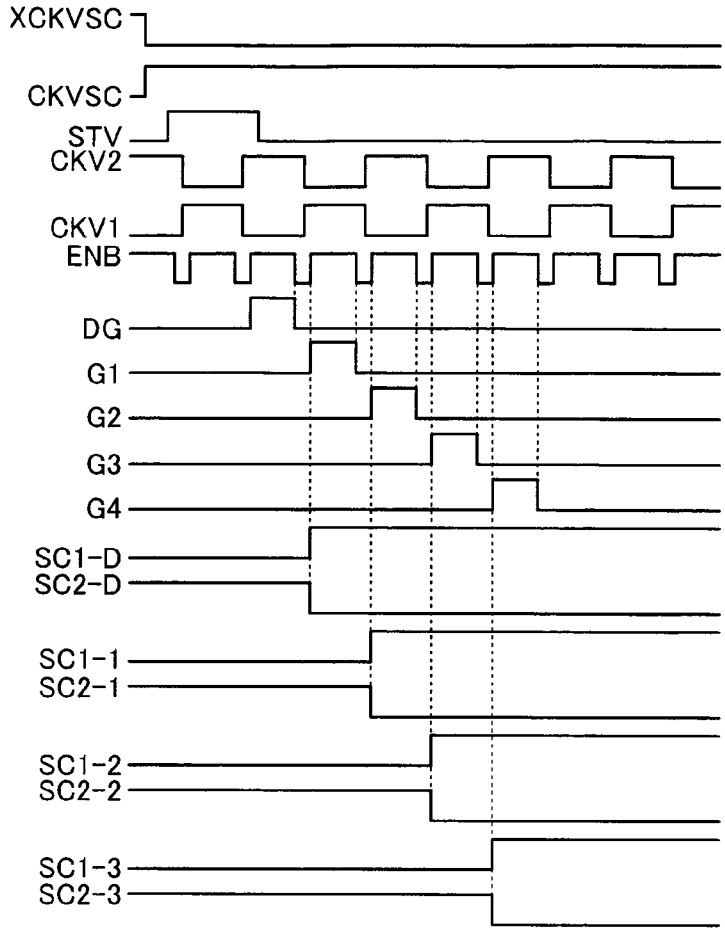
FIG. 4 is a timing chart for illustrating operations of the V driver of the liquid crystal display according to the first embodiment shown in FIG. 1.
Figure 5:
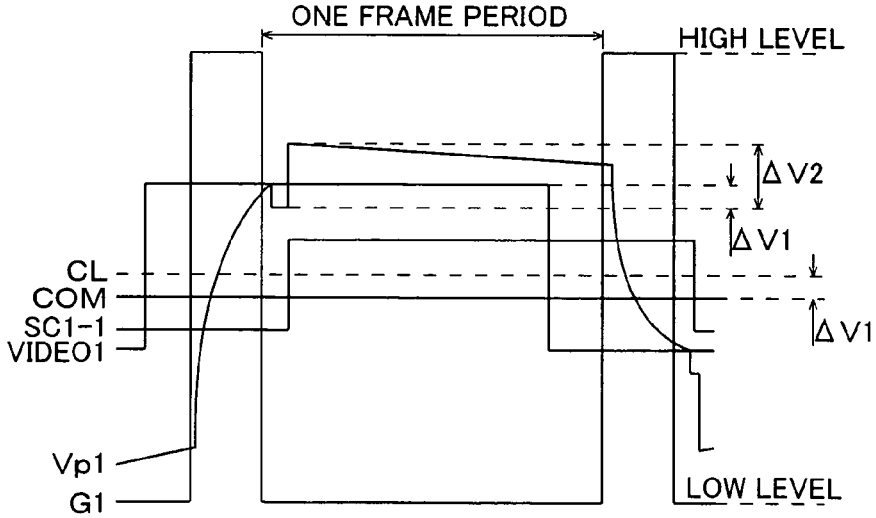
FIGS. 5 and 6 are waveform diagrams for illustrating operations of pixel portions of the liquid crystal display according to the first embodiment shown in FIG. 1.
Figure 6:
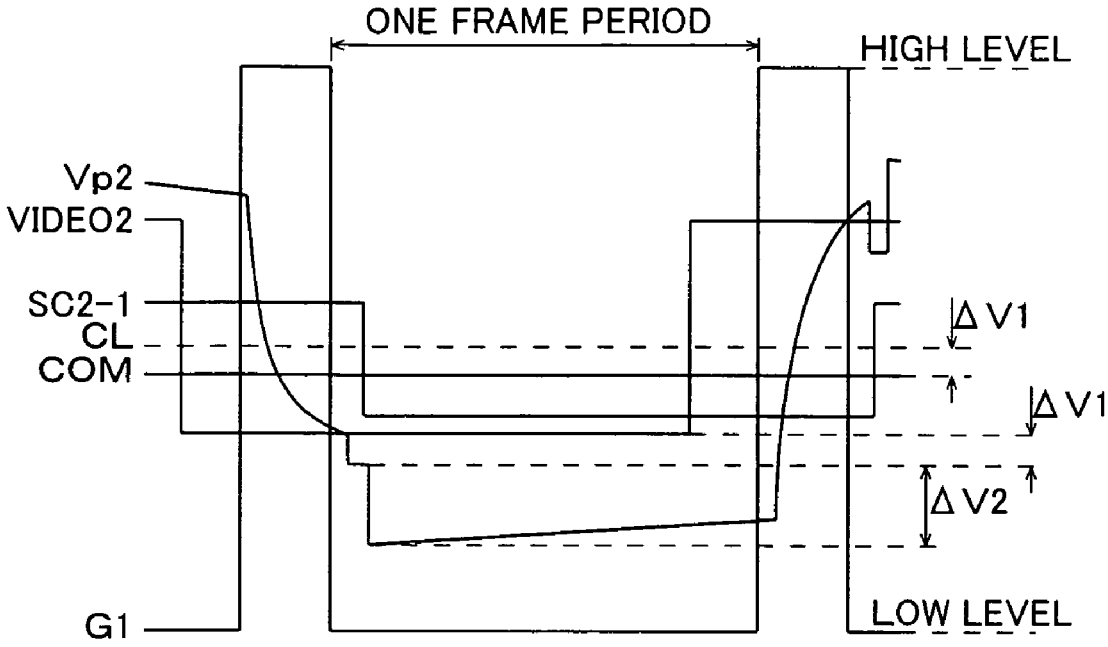

FIG. 4 is a timing chart for illustrating operations of the V driver 8 of the liquid crystal display according to the first embodiment shown in FIG. 3, and FIGS. 5 and 6 are waveform diagrams for illustrating operations of the pixel portions 3*a* and 3*b* of the liquid crystal display according to the first embodiment shown in FIG. 1. Operations of the liquid crystal display according to the first embodiment are now described with reference to FIGS. 1 to 6.

In an initial state, the shift signals SR1 to SR6 output from the nodes ND11 of the shift register circuit portions 61 to 66 and the shift output signals SR11 to SR16 output from the nodes ND12 of the shift register circuit portions 61 to 66 are at low levels. Output signals DG and G1 to G4 output from the nodes ND21 of the logic composition circuit portions 161 to 165 are also at low levels. Output signals SC1-D and SC1-1 to SC1-3 output from the nodes ND61 of the signal supply circuit portions 71 to 74 are at low levels, while output signals SC2-D and SC2-1 to SC2-3 output from the nodes ND62 of the signal supply circuit portions 71 to 74 are at high levels.

From the aforementioned initial state, the liquid crystal display first sets the clock signal CKVSC and the inverted clock signal XCKVSC to high and low levels respectively. The liquid crystal display holds the voltage levels of the clock signal CKVSC (high level) and the inverted clock signal XCKVSC (low level) for one frame period respectively.

Then, the liquid crystal display sets the start signal STV to a high level. At this time, the transistors NT2 and NT3 enter ON-states in the first circuit portion 61*a* of the first-stage shift register circuit portion 61. At this time, the node ND1 goes low and the transistor NT1 enters an OFF state through the ON-state transistor NT3. Therefore, the liquid crystal display inhibits a through current from flowing between the higher and lower voltages VDD and VBB despite the ON-state of the transistor NT2. The node ND2 goes low through the ON-state transistor NT2.

In the second circuit portion 61*b* of the first-stage shift register circuit portion 61, the transistor NT14 enters an ON-state. The transistors NT12 and NT13 receive a low-level signal from the node ND2 of the first circuit portion 61*a* in the gates thereof, to enter OFF-states. At this time, a clock signal CKV1 is at a low level, whereby the liquid crystal display holds the voltage of the node ND11 in the initial state (low level), while holding the transistor NT11 in an OFF-state. Thus, the liquid crystal display holds the voltage of the node ND12 in the initial state (low level). The liquid crystal display holds the second- to sixth-stage shift register circuit portions 62 to 66 in the initial states when holding the node ND12 of the first-stage shift register circuit portion 61 in the initial state (low level) in the aforementioned manner.

Then, the clock signal CKV1 and CKV2 go high (VDD) and low (VBB) respectively. At this time, the liquid crystal display holds the transistor NT4 receiving the low-level shift signal SR2 from the node ND11 of the second-stage shift register circuit portion 62 in its gate in an OFF-state in the first circuit portion 61*a* of the first-stage shift register circuit portion 61. Therefore, the liquid crystal display holds the nodes ND1 and ND2 at low levels. The liquid crystal display further inhibits a through current from flowing between the clock signal line (CKV1) and the lower voltage VBB despite the ON-state of the transistor NT3.

In the second circuit portion 61*b* of the first-stage shift register circuit portion 61, the node ND11 goes high due to the high-level clock signal CKV1 (VDD) supplied through the transistor NT14. Thus, the transistor NT11 enters an ON-state, and the node ND12 goes high due to the higher voltage VDD supplied through the transistor NT11. At this time, the liquid crystal display boots and raises the voltage of the node ND11 following rise of the voltage of the node ND12 (source voltage of the transistor NT11), in order to maintain the gate-to-source voltage of the transistor NT11 through the capacitor C11. Thus, the voltage of the node ND11 goes up to a level higher than VDD by a prescribed voltage (Vα) exceeding the threshold voltage (Vt).

At this time, the transistors NT2 and NT3 receiving the high-level shift output signal SR11 from the node ND12 of the first-stage shift register circuit portion 61 in the gates thereof enter ON-states in the first circuit portion 62*a* of the second-stage shift register circuit portion 62. Then, the node ND1 goes low and the transistor NT1 enters an OFF-state through the ON-state transistor NT3. Further, the node ND2 goes low through the ON-state transistor NT2.

In the second circuit portion 62*b* of the second-stage shift register circuit portion 62, the transistor NT14 receiving a high-level shift signal SR1 having a voltage (VDD+Vα) exceeding VDD+Vt from the node ND11 of the first-stage shift register circuit portion 61 in its gate enters an ON-state. Further, the transistors NT12 and NT13 receiving a low-level signal from the node ND2 of the first circuit portion 61*a* in the gates thereof enter OFF-states. AT this time, the clock signal CKV2 is at a low level, whereby the liquid crystal display holds the voltage of the node ND11 in the initial state (low level) while holding the transistor NT11 in an OFF-state. Thus, the liquid crystal display holds the voltage of the node ND12 in the initial state (low level). The liquid crystal display holds the third- to sixth-stage shift register circuit portions 63 to 66 in the initial states when holding the node ND12 of the second-stage shift register circuit portion 62 in the initial state (low level) in the aforementioned manner.

Then, the clock signals CKV1 and CKV2 go low (VBB) and high (VDD) respectively. At this time, the liquid crystal display holds the nodes ND1 and ND2 at low levels in the first circuit portion 61*a* of the first-stage shift register circuit portion 61.

In the second circuit portion 61*b* of the first-stage shift register circuit portion 61, the liquid crystal display holds the transistors NT12 and NT13 receiving a low-level signal from the node ND2 of the first circuit portion 61*a* in OFF-states. At this time, the liquid crystal display holds the node ND11 at a high level (VDD+Vα) since the low-level clock signal CKV1 does not flow back toward the node ND11 due to the diode-connected transistor NT15.

At this time, the liquid crystal display holds the transistor NT4 receiving a low-level shift signal SR3 from the node ND11 of the third-stage shift register circuit portion 63 in its gate in an OFF state in the first circuit portion 62*a* of the second-stage shift register circuit portion 62. Therefore, the liquid crystal display holds the nodes ND1 and ND2 at low levels while inhibiting a through current from flowing between the clock signal line (CKV2) and the lower voltage VBB.

In the second circuit portion 62*b* of the second-stage shift register circuit portion 62, the transistor NT14 receives a high-level shift signal SR1 (VDD+Vα) from the node ND11 of the first-stage shift register circuit portion 61 in its gate. The shift signal SR1 input in the gate of the transistor NT14 has the voltage (VDD+Vα) exceeding VDD+Vt, whereby the liquid crystal display inhibits the voltage of the clock signal CKV2 supplied to the source of the transistor NT14 from reduction by the threshold voltage (Vt) of the transistor NT14 from VDD.

In the second circuit portion 62*b* of the second-stage shift register circuit portion 62, the node ND11 goes high due to the high-level clock signal CKV2 (VDD) supplied through the transistor NT14. Thus, the transistor NT11 enters an ON-state, and the node ND12 goes high due to the higher voltage VDD supplied through the transistor NT11. At this time, the voltage of the node ND11 is booted through the capacitor C11, to go up to the level (VDD+Vα) higher than VDD by the prescribed voltage (Vα) exceeding the threshold voltage (Vt).

In the first circuit portion 63*a* of the third-stage shift register circuit portion 63, the transistors NT2 and NT3 receiving a high-level shift output signal SR12 from the node ND12 of the second-stage shift register circuit portion 62 in the gates thereof enter ON-states. At this time, the node ND1 goes low and the transistor NT1 enters an OFF-state through the ON-state transistor NT3. Further, the node ND2 goes low through the ON-state transistor NT2.

In the second circuit portion 63*b* of the third-stage shift register circuit portion 63, the transistor NT14 receiving a high-level shift signal SR2 (VDD+Vα) from the node ND11 of the second-stage shift register circuit portion 62 in its gate enters an ON-state. The transistors NT12 and NT13 receiving a low-level signal from the node ND2 of the first circuit portion 63*a* in the gates thereof enter OFF-states. At this time, the clock signal CKV1 is at a low level, whereby the liquid crystal display holds the voltage of the node ND11 in the initial state (low level) while holding the transistor NT11 in an OFF-state. Thus, the liquid crystal display holds the voltage of the node ND12 in the initial state (low level). The liquid crystal display holds the fourth- to sixth-stage shift register circuit portions 64 to 66 in the initial states when holding the node ND12 of the third-stage shift register circuit portion 63 in the initial state (low level) in the aforementioned manner.

At this time, the transistors NT21 and NT22 receive high-level shift signals SR1 and SR2 (VDD+Vα(>VDD+Vt)) from the nodes ND11 of the first- and second-stage shift register circuit portions 61 and 62 in the gates thereof respectively in the logic composition circuit portion 161 connected to the dummy gate line (DG). Thus, the transistors NT21 and NT22 enter ON-states. The liquid crystal display holds the transistor NT23 in an OFF-state. Thereafter the enable signal ENB goes high (VDD) so that the liquid crystal display supplies the high-level enable signal ENB (VDD) through the transistors NT21 and NT22, thereby setting the node ND21 to a high level. The transistor NT24 receiving a high-level output signal (DG) from the node ND21 in its gate enters an ON-state. The node ND22 goes low through the ON-state transistor NT24, thereby holding the transistor NT23 in an ON-state.

At this time, the liquid crystal display inhibits the voltage of the enable signal ENB supplied to the transistor NT22 from reduction by the threshold voltage (Vt) of the transistor NT21 from VDD due to the voltage (VDD+Vα), exceeding Vdd+Vt, of the shift signal SR1 input in the gate of the transistor NT21 in the logic composition circuit portion 161 connected to the dummy gate line (DG). The liquid crystal display further inhibits the voltage of the enable signal ENB supplied to the node ND21 from reduction by the threshold voltage (Vt) of the transistor NT22 from VDD due to the voltage (VDD+Vα), exceeding Vdd+Vt, of the shift signal SR2 input in the gate of the transistor NT22. Thus, the liquid crystal display supplies a high-level output signal DG (VDD) from the node ND21 to the dummy gate line DG.

In the logic composition circuit portion 162 connected to the first-stage gate line (G1), the transistors NT21 and NT22 receive a high-level shift signal SR2 (VDD+Vα) and a low-level shift signal SR3 from the nodes ND11 of the second- and third-stage shift register circuit portions 62 and 63 in the gates thereof respectively. Thus, the transistors NT21 and NT22 enter ON- and OFF-states respectively. At this time, the liquid crystal display supplies no high-level enable signal ENB due to the OFF-state transistor NT22. Therefore, the liquid crystal display supplies a low-level output signal G1 from the node ND21 to the first-stage gate line (G1).

In the logic composition circuit portions 163 to 165 connected to the second- to fourth-stage gate lines (G2 to G4), the transistors NT21 and NT22 receive low-level shift signals SR3 to SR6 from the nodes ND11 of the third- to sixth-stage shift register circuit portions 63 to 66 in the gates thereof respectively. Therefore, the liquid crystal display supplies low-level output signals G2 to G4 to the second- to fourth-stage gate lines (G2 to G4) from the nodes ND21, similarly to that supplied to the first-stage gate line (G1).

Then, the start signal STV goes low, and thereafter the enable signal ENB also goes low. Thus, the node ND21 goes low through the ON-state transistors NT21 and NT22 in the logic composition circuit portion 161 connected to the dummy gate line (DG). Therefore, the liquid crystal display supplies a low-level output signal DG to the dummy gate line (DG) from the node ND21. The liquid crystal display holds the current voltage level (low level) of the node ND22 for one frame period. In other words, the liquid crystal display continuously supplies the low-level output signal DG from the node ND21 to the dummy gate line (DG) for one frame period.

Then, the clock signal CKV1 goes high (VDD), and the clock signal CKV2 goes low (VBB). At this time, the transistors NT2 and NT3 receiving the low-level start signal STV in the gates thereof are in OFF-states in the first circuit portion 61*a* of the first-stage shift register circuit portion 61. The liquid crystal display holds the transistor NT4, receiving the high-level shift signal SR2 (VDD+Vα) from the node ND11 of the second-stage shift register circuit portion 62, in an ON-state. Therefore, the liquid crystal display supplies a high-level clock signal CKV1 (VDD) through the transistors NT4 and NT5, thereby setting the node ND1 to a high level and turning on the transistor NT1. Thus, the node ND2 goes high through the ON- and OFF-state transistors NT1 and NT2. The liquid crystal display inhibits the voltage of the clock signal CKV1 supplied to the source of the transistor NT4 from reduction by the threshold voltage (Vt) of the transistor NT4 from VDD due to the voltage (VDD+Vα), exceeding VDD+Vt, of the shift signal SR2 input in the gate of the transistor NT4.

In the second circuit portion 61*b* of the first-stage shift register circuit portion 61, the transistors NT12 and NT13 receiving a high-level signal from the node ND2 of the first circuit portion 61*a* enter ON-states. Thus, the nodes ND12 and ND11 go low through the ON-state transistors NT12 and NT13. At this time, the transistor NT14 receiving the low-level start signal STV in its gate is in an OFF-state. Therefore, the liquid crystal display inhibits a through current from flowing between the clock signal line (CKV1) and the lower voltage VBB despite the ON-state of the transistor NT13. Further, the node ND11 goes low to turn off the transistor NT11, whereby the liquid crystal display inhibits a through current from flowing between the higher and lower voltages VDD and VBB despite the ON-state of the transistor NT12.

In the first circuit portion 62*a* of the second-stage shift register circuit portion 62, the transistors NT2 and NT3 receiving a low-level shift output signal SR11 from the node ND12 of the first-stage shift register circuit portion 61 enter OFF-states. The liquid crystal display holds the nodes ND1 and ND2 at low levels.

In the second circuit portion 62*b* of the second-stage shift register circuit portion 62, the transistors NT12 and NT13 receiving a low-level signal from the node ND2 of the first circuit portion 62*a* in the gates thereof enter OFF-states. The transistor NT14 receiving a low-level shift signal SR1 from the node ND11 of the first-stage shift register circuit portion 61 in its gate also enters an OFF-state. Thus, the liquid crystal display holds the node ND11 at a high level (VDD+Vα) while holding the transistor NT11 in an ON-state, thereby holding the node ND12 at a high level.

In the first circuit portion 63*a* of the third-stage shift register circuit portion 63, the liquid crystal display holds the transistors NT2 and NT3 receiving the high-level shift output signal SR12 from the node ND12 of the second-stage shift register circuit portion 62 in the gates thereof in ON-states. Thus, the liquid crystal display holds the nodes ND1 and ND2 at low levels. At this time, the liquid crystal display holds the transistor NT4 receiving a low-level shift signal SR4 from the node ND11 of the fourth-stage shift register circuit portion 64 in its gate in an OFF-state.

In the second circuit portion 63*b* of the third-stage shift register circuit portion 63, the liquid crystal display holds the transistors NT12 and NT13 receiving a low-level signal from the node ND2 of the first circuit portion 63*a* in OFF-states. The transistor NT14 receiving the high-level shift signal SR2 (VDD+Vα) from the node ND11 of the second-stage shift register circuit portion 62 in its gate enters an ON-state. The node ND11 supplied with the high-level clock signal CKV1 (VDD) through the transistor NT14 goes high. Thus, the transistor NT11 enters an ON-state, and the node ND12 supplied with the higher voltage VDD through the transistor NT11 goes high. At this time, the liquid crystal display boots the voltage of the node ND11 through the capacitor C11 thereby raising the same to the level (VDD+Vα) higher than VDD by the prescribed voltage (Vα) exceeding the threshold voltage (Vt).

In the first circuit portion 64*a* of the fourth-stage shift register circuit portion 64, the transistors NT2 and NT3 receiving a high-level shift output signal SR13 from the node ND12 of the third-stage shift register circuit portion 63 in the gates thereof enter ON-states. At this time, the node ND1 goes low and the transistor NT1 enters an OFF-state due to the ON-state transistor NT3. Further, the node ND2 goes low due to the ON-state transistor NT2.

In the second circuit portion 64*b* of the fourth-stage shift register circuit portion 64, the transistor NT14 receiving a high-level shift signal SR3 (VDD+Vα) from the node ND11 of the third-stage shift register circuit portion 63 in its gate enters an ON-state. The transistors NT12 an NT13 receiving a low-level signal from the node ND2 of the first circuit portion 64*a* in the gates thereof enter OFF-states. At this time, the clock signal CKV2 is at a low level, whereby the liquid crystal display holds the voltage of the node ND11 in the initial state (low level) while holding the transistor NT11 in an OFF-state. Thus, the liquid crystal display holds the voltage of the node ND12 in the initial state (low level). The liquid crystal display holds the fifth- and sixth-stage shift register circuit portions 65 and 66 in the initial states when holding the node ND12 of the fourth-stage shift register circuit portion 64 in the initial state (low level).

At this time, the transistors NT21 and NT22 receive the low-level shift signal SR1 and the high-level shift signal SR2 (VDD+Vα) from the nodes ND11 of the first- and second-stage shift register circuit portions 61 in the gates thereof respectively in the logic composition circuit portion 161 connected to the dummy gate line (DG). Thus, the transistors NT21 and NT22 enter OFF- and ON-states respectively. Further, the transistor NT23 receiving the high-level shift output signal SR13 from the node ND12 of the third-stage shift register circuit portion 63 in its gate through the transistor NT25 enter an ON-state. Thus, the liquid crystal display holds the node ND21 at a low level, thereby supplying a low-level output signal DG to the dummy gate line (DG) from the node ND21. At this time, the liquid crystal display charges the capacitor C21, thereby holding the transistor NT23 in an ON-state until the same subsequently supplies the lower voltage VBB by turning on the transistor NT24.

In the logic composition circuit portion 162 connected to the first-stage gate line (G1), the transistors NT21 and NT22 receive high-level shift signals SR2 and SR3 (VDD+Vα) from the nodes ND11 of the second- and third-stage shift register circuit portions 62 and 63 in the gates thereof respectively. Thus, the transistors NT21 and NT22 enter ON-states. The liquid crystal display holds the transistor NT23 in an OFF-state. Thereafter the enable signal ENB goes high (VDD) so that the liquid crystal display supplies the high-level enable signal ENB (VDD) through the transistors NT21 and NT22, whereby the node ND21 goes high and the liquid crystal display supplies a high-level output signal G1 (VDD) from the node ND21 to the first-stage gate line (G1). The liquid crystal display inputs the high-level output signal G1 (VDD) from the node ND21 also in the gate of the transistor NT24. Therefore, the transistor NT24 enters an ON-state, and the node ND22 goes low through the ON-state transistor NT24. Thus, the liquid crystal display holds the transistor NT23 in an OFF-state.

In the logic composition circuit portion 163 connected to the second-stage gate line (G2), the transistors NT21 and NT22 receive the high-level shift signal SR3 (VDD+Vα) and the low-level shift signal SR4 from the nodes ND11 of the third- and fourth-stage shift register circuit portion 63 and 64 in the gates thereof respectively. Therefore, the liquid crystal display supplies the second-stage gate line (G2) with not a high-level, but a low-level output signal G2 despite the high level (VDD) of the enable signal ENB.

In the logic composition circuit portions 164 and 165 connected to the third- and fourth-stage gate lines (G3 and G4), the transistors NT21 and NT22 receive low-level shift signals SR4 to SR6 from the fourth- to sixth-stage shift register circuit portions 64 to 66 in the gates thereof respectively. Therefore, the liquid crystal display supplies low-level output signals G3 and G4 from the nodes ND21 to the third- and fourth-stage gate lines (G3 and G4), similarly to that for the second-stage gate line (G2).

Thereafter the enable signal ENB goes low, whereby the node ND21 goes low through the ON-state transistors NT21 and NT22 in the logic composition circuit portion 162 connected to the first-stage gate line (G1). Thus, the liquid crystal display supplies a low-level output signal G1 from the node ND21 to the first-stage gate line (G1). The liquid crystal display holds the current voltage level (low level) of the node ND21 for one frame period. In other words, the liquid crystal display continuously supplies the low-level output signal G1 from the node ND21 to the first-stage gate line (G1) for one frame period. As hereinabove described, the high-level output signals DG and G1 supplied to the dummy gate line (DG) and the first-stage gate line (G1) respectively forcibly go low due to the fall of the enable signal ENB to the low level. Thus, the liquid crystal display inhibits high-level periods of the output signals DG and G1 supplied to the dummy gate line (DG) and the first-stage gate line (G1) respectively from overlapping with each other.

The liquid crystal display performs operations similar to the aforementioned ones on the first-stage shift register circuit portion 61 also on the second- to sixth-stage shift register circuit portions 62 to 66. Further, the liquid crystal display performs operations similar to those on the logic composition circuit portion 161 connected to the dummy gate line (DG) also on the logic composition circuit portions 162 to 165 connected to the first- to fourth-stage gate lines (G1 to G4) respectively. After the output signal G1 supplied to the first-stage gate line (G1) goes low, the output signals G2 to G4 supplied to the second- to fourth-stage gate lines (G2 to G4) respectively sequentially go high in synchronization with the enable signal ENB. Thereafter the output signals G2 to G4 supplied to the second- to fourth-stage gate lines (G2 to G4) respectively sequentially go low in synchronization with the enable signal ENB. In this case, the liquid crystal display supplies the output signals to the gate lines in synchronization with the enable signal ENB, thereby inhibiting high-level periods of the output signals supplied to adjacent gate lines from overlapping with each other. The liquid crystal display holds the voltage levels (low levels) of the output signals, going low from high levels, supplied to the gate lines for one frame period.

According to the first embodiment, the liquid crystal display supplies the output signal G1 from the node ND21 of the logic composition circuit portion 162 connected to the first-stage gate line (G1) also to the signal supply circuit portion 71 connected to the dummy subsidiary capacitance lines (SC1-D and SC2-D) through the first-stage gate line (G1). When the output signal G1 goes high, the liquid crystal display operates as follows:

In the first signal generation circuit portion 71*a* of the signal supply circuit portion 71 connected to the dummy subsidiary capacitance lines (SC1-D and SC2-D), the transistors NT32 and NT33 receiving a high-level clock signal CKVSC in the gates thereof are in ON-states. Therefore, the node ND31 is at a low level due to the ON-state transistor NT33. At this time, the transistor NT34 receiving a low-level inverted clock signal XCKVSC in its gate is in an OFF-state. Thus, the liquid crystal display inhibits a through current from flowing between the first-stage gate line (G1) and the lower voltage VBB despite the ON-state of the transistor NT33. Further, the node ND32 is also at a low level through the ON-state transistor NT32. At this time, the transistor NT31 is in an OFF-state due to the low level of the node ND31. Thus, the liquid crystal display inhibits a through current from flowing between the higher and lower voltages VDD and VBB despite the ON-state of the transistor NT32.

In the second signal generation circuit portion 71*b* of the signal supply circuit portion 71 connected to the dummy subsidiary capacitance lines (SC1-D and SC2-D), the transistors NT42 and NT43 receiving a low-level signal from the node ND32 of the first signal generation circuit portion 71*a* in the gates thereof are in OFF-states. Further, the transistor NT44 receiving the high-level clock signal CKVSC in its gate is in an ON-state. Therefore, the liquid crystal display supplies a high-level output signal G1 through the transistors NT44 and NT45, thereby setting the node ND41 to a high level. Thus, the transistor NT41 enters an ON-state, and the liquid crystal display supplies the higher voltage VDD through the transistor NT41, whereby the node ND42 goes high. At this time, the liquid crystal display boots and raises the voltage of the node ND41 following rise of the voltage of the node ND42 (source voltage of the transistor NT41), in order to maintain the gate-to-source voltage of the transistor NT41 through the capacitor C41. Thus, the liquid crystal display reliably holds the transistor NT41 in an ON-state.

In the third signal generation circuit portion 71*c* of the signal supply circuit portion 71 connected to the dummy subsidiary capacitance lines (SC1-D and SC2-D), the transistors NT52 and NT53 receiving a high-level signal from the node ND42 of the second signal generation circuit portion 71*b* in the gates thereof are in ON-states. Therefore, the node ND51 is at a low level due to the ON-state transistor NT53. At this time, the transistor NT54 receiving the low-level inverted clock signal XCKVSC in its gate is in an OFF-state. Thus, the liquid crystal display inhibits a through current from flowing between the first-stage gate line (G1) and the lower voltage VBB despite the ON-state of the transistor NT53. The node ND52 is also at a low level through the ON-state transistor NT52. At this time, the transistor NT51 is also in an OFF-state due to the low level of the node ND51. Thus, the liquid crystal display inhibits a through current from flowing between the higher and lower voltages VDD and VBB despite the ON-state of the transistor NT52.

In the signal switching circuit portion 71*d* of the signal supply circuit portion 71 connected to the dummy subsidiary capacitance lines (SC1-D and SC2-D), the transistors NT61 and NT62 receiving a high-level signal from the node ND42 of the second signal generation circuit portion 71*d* in the gates thereof are in ON-states. On the other hand, the transistors NT62 and NT63 receiving a low-level signal from the node ND52 of the third signal generation circuit portion 71*c* in the gates thereof are in OFF-states. Thus, the liquid crystal display supplies a high-level output signal SC1-D (high voltage VSCH) of positive polarity and a low-level output signal SC2-D (low voltage VSCL) of negative polarity to the dummy subsidiary capacitance lines (SC1-D and SC2-D) through the transistors NT61 and NT64 respectively.

When the output signal G1 supplied to the first-stage gate line (G1) goes low from a high level, the liquid crystal display operates as follows: The liquid crystal display continuously inputs the high-level clock signal CKVSC in the gates of the transistors NT32 and NT33 in the first signal supply circuit portion 71*a* of the signal supply circuit portion 71 connected to the dummy subsidiary capacitance lines (SC1-D and SC2-D), thereby holding the transistors NT32 and NT33 in ON-states. Thus, the liquid crystal display holds the nodes ND31 and ND32 at low levels.

In the second signal generation circuit portion 71*b* of the signal supply circuit portion 71 connected to the dummy subsidiary capacitance lines (SC1-D and SC2-D), the liquid crystal display continuously inputs the low-level signal from the node ND32 of the first signal generation circuit 71*a* in the gates of the transistors NT42 and NT43, thereby holding the transistors NT42 and NT43 in OFF-states. Further, the liquid crystal display continuously inputs the high-level clock signal CKVSC in the gate of the transistor NT44, thereby holding the transistor NT44 in an ON-state. At this time, the liquid crystal display holds the node ND41 at a high level since the low-level output signal G1 does not flow back due to the diode-connected transistor NT45. Therefore, the liquid crystal display holds the transistor NT41 in an ON-state, thereby continuously supplying the higher voltage VDD through the transistor NT41. Thus, the liquid crystal display holds the node ND42 at a high level.

In the third signal generation circuit portion 71*c* of the signal supply circuit portion 71 connected to the dummy subsidiary capacitance lines (SC1-D and SC2-D), the liquid crystal display continuously inputs a high-level signal from the node ND42 of the second signal generation circuit portion 71*b* in the gates of the transistors NT52 and NT53, thereby holding the transistors NT52 and NT53 in ON-states. Thus, the liquid crystal display holds the nodes ND51 and ND52 at low levels.

In the signal switching circuit portion 71*d* of the signal supply circuit portion 71 connected to the dummy subsidiary capacitance lines (SC1-D and SC2-D), the liquid crystal display continuously inputs a high-level signal from the node ND42 of the second signal generation circuit portion 71*b* in the gates of the transistors NT61 and NT64, thereby holding the transistors NT61 and NT64 in ON-states. The liquid crystal display further continuously inputs a low-level signal from the node ND52 of the third signal generation circuit portion 71*c* in the gates of the transistors NT62 and NT63, thereby holding the transistors NT62 and NT63 in OFF-states. Thus, the liquid crystal display continuously supplies the high- and low-level output signals SC1-D and SC2-D (high and low voltages VSCH and VSCL) of positive polarity and negative polarity to the dummy subsidiary capacitance lines (SC1-D and SC2-D) through the transistors NT61 and NT64 respectively. The liquid crystal display holds the voltage levels of the output signals SC1-D and SC2-D (high and low levels) supplied to the dummy subsidiary capacitance lines (SC1-D and SC2-D) respectively for one frame period.

The liquid crystal display performs operations similar to those on the signal supply circuit portion 71 connected to the dummy subsidiary capacitance lines (SC1-D and SC2-D) also on the signal supply circuit portions 72 to 74 connected to the first- to third-stage subsidiary capacitance lines (SC1-1 to SC1-3 and SC2-1 to SC2-3) respectively. In other words, the output signal G2 supplied to the second-stage gate line (G2) goes high, so that the liquid crystal display supplies high- and low-level output signals SC1-1 and SC2-1 (high and low voltages VSCH and VSCL) to the first-stage subsidiary capacitance lines (SC1-1 and SC2-1) respectively. Further, the output signal G3 supplied to the third-stage gate line (G3) goes high, so that the liquid crystal display supplies high- and low-level output signals SC1-2 and SC2-2 (high and low voltages VSCH and VSCL) to the second-stage subsidiary capacitance lines (SC1-2 and SC2-2) respectively. In addition, the output signal G4 supplied to the fourth-stage gate line (G4) goes high, so that the liquid crystal display supplies high- and low-level output signals SC1-3 and SC2-3 (high and low voltages VSCH and VSCL) to the third-stage subsidiary capacitance lines (SC1-3 and SC2-3) respectively. The liquid crystal display holds the voltage levels of the output signals SC1-1 to SC1-3 (high levels) and SC2-1 to SC2-3 (low levels) supplied to the first- to third-stage subsidiary capacitance lines (SC1-1 to SC1-3 and SC2-1 to SC2-3) respectively for one frame period.

The liquid crystal display performs operations similar to the above also on each signal supply circuit portion connected to each of fourth-stage and subsequent pairs of subsidiary capacitance lines. In other words, the liquid crystal display supplies high- and low-level output signals (high and low voltages VSCH and VSCL) of positive polarity and negative polarity to a prescribed stage of pair of subsidiary capacitance lines corresponding to a prescribed stage of gate line respectively simultaneously with supplying a high-level output signal to a subsequent gate line. The liquid crystal display holds the voltage levels of the high- and low-level output signals (high and low voltages VSCH and VSCL) supplied to the pair of subsidiary capacitance lines for one frame period.

In the display portion 2 shown in FIG. 1, the liquid crystal display operates as follows, for example: The liquid crystal display first supplies high- and low-level video signals VIDEO1 and VIDEO2 to the video signal lines (VIDEO1 and VIDEO2) respectively. Then, the liquid crystal display sequentially supplies a high-level signal to the gates of the transistors 4*a* and 4*b* from the H driver 5, thereby sequentially turning on the transistors 4*a* and 4*b*. Thus, the liquid crystal display supplies the high- and low-level video signals VIDEO1 and VIDEO2 from the video signal lines (VIDEO1 and VIDEO2) to the drain lines (D1 and D2) of the pixel portions 3*a* and 3*b* respectively. Thereafter the liquid crystal display supplies the high-level output signal G1 to the first-stage gate line (G1), as hereinabove described.

Thereafter the liquid crystal display turns on the transistor 32 in the pixel portion 3*a*, thereby writing the high-level video signal VIDEO1 in the pixel portion 3*a*. In other words, a pixel voltage Vp1 goes up to the voltage of the video signal VIDEO, as shown in FIG. 5. Then, the output signal G1 supplied to the first-stage gate line (G1) goes low, thereby turning off the transistor 32. Thus, the liquid crystal display completes writing the high-level video signal VIDEO1 in the pixel portion 3*a*. At this time, the liquid crystal display drops the pixel voltage VP1 by ΔV1 due to the fall of the output signal G1 supplied to the first-stage gate line (G1) to a low level. The liquid crystal display previously sets the voltage of the common electrode (COM) 35 to a level lower than the center level CL of the voltage of the video signal VIDEO1 by ΔV1 in consideration of the fall of the pixel voltage Vp1 by ΔV1.

According to the first embodiment, the liquid crystal display supplies the high voltage VSCH of positive polarity to the subsidiary capacitance line (SC1-1) after the output signal G1 supplied to the first-stage gate line (G1) goes low, thereby supplying the high-level output signal SC1-1 (high voltage VSCH) to the second electrode 37*a* (see FIG. 1) of the subsidiary capacitor 33 and raising the voltage of the subsidiary capacitor 33 to a high level. Thus, the liquid crystal display redistributes charges between the liquid crystal layer 31 and the subsidiary capacitor 33, thereby raising the pixel voltage Vp1 by ΔV2 as shown in FIG. 5. The liquid crystal display holds the pixel voltage Vp1 raised by ΔV2 for one frame period (until the transistor 32 re-enters an ON-state). The pixel voltage source Vp1 slightly fluctuates with time due to influence by a leakage current or the like.

In the pixel portion 3*b* (see FIG. 1), the liquid crystal display turns on the transistor 32, thereby writing the low-level video signal VIDEO2 in the pixel portion 3*b*. In other words, the liquid crystal display drops a pixel voltage Vp2 to the level of the video signal VIDEO2, as shown in FIG. 6. Then, the output signal G1 supplied to the first-stage gate line (G1) goes low, thereby turning off the transistor 32. Thus, the liquid crystal display completes writing the low-level video signal VIDEO2 in the pixel portion 3*b*, and drops the pixel voltage Vp2 by ΔV1. After the output signal G1 supplied to the first-stage gate line (G1) goes low, the liquid crystal display supplies the low voltage VSCL of negative polarity to the subsidiary capacitance line (SC2-1), thereby supplying the low-level output signal SC2-1 (low voltage VSCL) to the second electrode 37*b* (see FIG. 1) of the subsidiary capacitance line 33 and dropping the voltage of the subsidiary capacitor 33 to a low level. Thus, the liquid crystal display drops the pixel voltage Vp2 by ΔV2, and holds the pixel voltage Vp2 dropped by ΔV2 for one frame period.

The liquid crystal display sequentially performs operations similar to those on the pixel portions 3*a* and 3*b* arranged along the first-stage gate line (G1) also on the pixel portions arranged along the second- to fourth-stage gate lines (G2 to G4) (see FIG. 2) respectively.

After completing first-frame operations, the liquid crystal display inverts black and white voltages of the video signals VIDEO1 and VIDEO2 supplied to the video signal lines (VIDEO1 and VIDEO2) respectively with respect to the voltage of the common electrode (COM) 35 in a second frame.

In the second frame, the liquid crystal display switches the clock signal CKVSC and the inverted clock signal XCKVSC supplied to the signal supply circuit 7 to low and high levels respectively. When the output signal G1 supplied to the first-stage gate line (G1) goes high in this case, the liquid crystal display operates as follows:

In the first signal generation circuit portion 71*a* of the signal supply circuit portion 71 connected to the dummy subsidiary capacitance lines (SC1-D and SC2-D), the transistors NT32 and NT33 receiving the low-level clock signal CKVSC in the gates thereof enter OFF-states. Further, the transistor NT34 receiving the high-level inverted clock signal XCKVSC in its gate enters an ON-state. Therefore, the liquid crystal display supplies a high-level output signal G1 through the transistors NT34 and NT35, thereby setting the node ND31 to a high level. Thus, the transistor NT31 enters an ON-state, while the liquid crystal display supplies the higher voltage VDD through the transistor NT31 thereby setting the node ND32 to a high level. At this time, the liquid crystal display boots and raises the voltage of the node ND31 following rise of the voltage of the node ND32 (source voltage of the transistor NT31), in order to maintain the gate-to-source voltage of the transistor NT31 through the capacitor C31. Thus, the liquid crystal display reliably holds the transistor NT31 in an ON-state.

In the second signal generation circuit portion 71*b* of the signal supply circuit portion 71 connected to the dummy subsidiary capacitance lines (SC1-D and SC2-D), the transistors NT42 and NT43 receiving a high-level signal from the node ND32 of the first signal generation circuit portion 71*a* in the gates thereof enter ON-states. Therefore, the node ND41 goes low due to the ON-state transistor NT43. At this time, the transistor NT44 receiving the low-level clock signal CKVSC in its gate enters an OFF-state. Thus, the liquid crystal display inhibits a through current from flowing between the first-stage gate line (G1) and the lower voltage VBB despite the ON-state of the transistor NT43. The node ND42 also goes low through the ON-state transistor NT42. At this time, the node ND41 goes low, thereby turning off the transistor NT41. Thus, the liquid crystal display inhibits a through current from flowing between the higher and lower voltages VDD and VBB despite the ON-state of the transistor NT42.

In the third signal generation circuit portion 71*c* of the signal supply circuit portion 71 connected to the dummy subsidiary capacitance lines (SC1-D and SC2-D), the transistors NT52 and NT53 receiving a low-level signal from the node ND42 of the second signal generation circuit portion 71*b* in the gates thereof enter OFF-states. Further, the transistor NT54 receiving the high-level inverted clock signal XCKVSC in its gate enters an ON-state. Therefore, the liquid crystal display supplies the high-level output signal G1 through the transistors NT54 and NT55, whereby the node ND51 goes high. Thus, the transistor NT51 enters an ON-state, and the liquid crystal display supplies the higher voltage VDD through the transistor NT51 thereby setting the node ND52 to a high level. At this time, the liquid crystal display boots and raises the voltage of the node ND51 following rise of the voltage of the node ND52 (source voltage of the transistor NT51), in order to maintain the gate-to-source voltage of the transistor NT51 through the capacitor C51. Thus, the liquid crystal display reliably holds the transistor NT51 in an ON-state.

In the signal switching circuit portion 71*d* of the signal supply circuit portion 71 connected to the dummy subsidiary capacitance lines (SC1-D and SC2-D), the transistors NT61 and NT64 receiving a low-level signal from the node ND42 of the second signal generation circuit portion 71*b* in the gates thereof enter OFF-states. On the other hand, the transistors NT62 and NT63 receiving a high-level signal from the node ND52 of the third signal generation circuit portion 71*c* in the gates thereof enter ON-states. Thus, the liquid crystal display supplies low- and high-level output signals SC1-D and SC2-D (low and high voltage supply voltages VSCL and VSCH) of negative polarity and positive polarity to the dummy subsidiary capacitance lines (SC1-D and SC2-D) through the transistors NT62 and NT63 respectively.

When the output signal G1 supplied to the first-stage gate line (G1) goes low from a high level, the liquid crystal display operates as follows: In the first signal generation circuit portion 71*a* of the signal supply circuit portion 71 connected to the dummy subsidiary capacitance lines (SC1-D and SC2-D), the liquid crystal display continuously inputs the low-level clock signal CKVSC in the gates of the transistors NT32 and NT33, thereby holding the transistors NT32 and NT33 in OFF-states. Further, the liquid crystal display continuously inputs the high-level inverted clock signal XCKVSC in the gate of the transistor NT34, thereby holding the transistor NT34 in an ON-state. At this time, the low-level output signal G1 does not flow back due to the diode-connected transistor NT35, whereby the liquid crystal display holds the node ND31 at a high level. Therefore, the liquid crystal display also holds the transistor NT31 in an ON-state, thereby continuously supplying the higher voltage VDD through the transistor NT31. Thus, the liquid crystal display holds the node ND32 at a high level.

In the second signal generation circuit portion 71*b* of the signal supply circuit portion 71 connected to the dummy subsidiary capacitance lines (SC1-D and SC2-D), the liquid crystal display continuously inputs a high-level signal from the node ND32 of the first signal generation circuit portion 71*a* in the gates of the transistors NT42 and NT43, thereby holding the transistors NT42 and NT43 in ON-states. Thus, the liquid crystal display holds the nodes ND41 and ND42 at low levels.

In the third signal generation circuit portion 71*c* of the signal supply circuit portion 71 connected to the dummy subsidiary capacitance lines (SC1-D and SC1-D), the liquid crystal display continuously inputs a low-level signal from the node ND42 of the second signal generation circuit portion 71*b* in the gates of the transistors NT52 and NT53, thereby holding the transistors NT52 and NT53 in OFF-states. Further, the liquid crystal display continuously inputs the high-level inverted clock signal XCKVSC in the gate of the transistor NT54, thereby holding the transistor NT54 in an ON-state. At this time, the low-level output signal G1 does not flow back due to the diode-connected transistor NT55, whereby the liquid crystal display holds the node ND51 at a high level. Therefore, the liquid crystal display holds the transistor NT51 in an ON-state, thereby continuously supplying the higher voltage VDD through the transistor NT51. Thus, the liquid crystal display holds the node ND52 at a high level.

In the signal switching circuit portion 71*d* of the signal supply circuit portion 71 connected to the dummy subsidiary capacitance lines (SC1-D and SC2-D), the liquid crystal display continuously inputs a low-level signal from the node ND42 of the second signal generation circuit portion 71*b* in the gates of the transistors NT61 and NT64, thereby holding the transistors NT61 and NT64 in OFF-states. Further, the liquid crystal display continuously inputs a high-level signal from the node ND52 of the third signal generation circuit portion 71*c* in the gates of the transistors NT62 and NT63, thereby holding the transistors NT62 and NT63 in ON-states. Thus, the liquid crystal display continuously supplies low- and high-level output signals SC1-D and SC2-D (low and high voltages VSCL and VSCH) of negative polarity and positive polarity to the dummy subsidiary capacitance lines (SC1-D and SC2-D) through the transistors NT62 and NT63 respectively. The liquid crystal display holds the voltage levels of the output signals SC1-D and SC2-D (low and high levels) supplied to the dummy subsidiary capacitance lines (SC1-D and SC2-D) respectively for one frame period.

Also on the signal supply circuit portions 72 to 74 connected to the first- to third-stage subsidiary capacitance lines (SC1-1 to SC1-3) and the subsidiary capacitance lines (SC2-1 to SC2-3), the liquid crystal display performs operations similar to those on the signal supply circuit portion 71 connected to the dummy subsidiary capacitance lines (SC1-D and SC2-D). In other words, an output signal G2 supplied to the second-stage gate line (G2) goes high, so that the liquid crystal display supplies low- and high-level output signals SC1-1 and SC2-1 (low and high voltages VSCL and VSCH) to the first-stage subsidiary capacitance lines (SC1-1 and SC2-1) respectively. An output signal G3 supplied to the third-stage gate line (G3) goes high, so that the liquid crystal display supplies low- and high-level output signals SC1-2 and SC2-2 (low and high voltages VSCL and VSCH) to the second-stage subsidiary capacitance lines (SC1-2 and SC2-2) respectively. An output signal G4 supplied to the fourth-stage gate line (G4) goes high, so that the liquid crystal display supplies low- and high-level output signals SC1-3 and SC2-3 (low and high voltages VSCL and VSCH) to the third-stage subsidiary capacitance lines (SC1-3 and SC2-3) respectively. The liquid crystal display holds the voltage levels of the output signals SC1-1 to SC1-3 (low levels) and SC2-1 to SC2-3 (high levels) supplied to the first- to third-stage subsidiary capacitance lines (SC1-1 to SC1-3 and SC2-1 to SC2-3) respectively for one frame period.

Thus, the liquid crystal display operates in the pixel portions 3*a* and 3*b* as shown in FIGS. 6 and 5 respectively in the second frame. Also in third and subsequent frames, the liquid crystal display inverts black and white voltage supply voltages of video signals VIDEO1 and VIDEO2 supplied to the video signal lines (VIDEO1 and VIDEO2) respectively with respect to the voltage of the common electrode (COM) 35 every frame period. The liquid crystal display further alternately switches the clock signal CKVSC supplied to the signal supply circuit 7 between high and low levels every frame period. Thus, the liquid crystal display alternately switches the voltage levels of the output signals SC1-1 to SC1-3 and SC2-1 to SC2-3 supplied to the first- to third-stage subsidiary capacitance lines (SC1-1 to SC1-3 and SC2-1 to SC2-3) respectively between the high and low levels (high and low voltages VSCH and VSCL) every frame period. The liquid crystal display according to the first embodiment is driven in this manner.

According to the first embodiment, as hereinabove described, the liquid crystal display provided with the signal supply circuit 7 including the signal supply circuit portions 71 to 74 for supplying the high- and low-level signals (high and low voltages VSCH and VSCL) of positive polarity and negative polarity to the subsidiary capacitance lines (SC1-1 to SC1-3 and SC2-1 to SC2-3) corresponding to the pixel portions 3*a* and 3*b* respectively can raise the voltage of the subsidiary capacitor 33 of the pixel portion 3*a* to a high level by supplying the high-level output signals SC1-1 to SC1-3

(high voltage VSCH) to the second electrode 37*a* of the subsidiary capacitor 33 of the pixel portion 3*a* assuming that the output signals SC1-1 to SC1-3 and SC2-1 to SC2-3 from the subsidiary capacitance lines corresponding to the pixel portions 3*a* and 3*b* respectively are at high and low levels (high and low voltages VSCH and VSCL) respectively, for example. Further, the liquid crystal display can drop the voltage of the subsidiary capacitor 33 of the pixel portion 3*b* to a low level by supplying the low-level output signals SC2-1 to SC2-3 (low voltage VSCL) to the second electrode 37*b* of the subsidiary capacitor 33 of the pixel portion 3*b*. Thus, the liquid crystal display can render the pixel voltage Vp1 of the pixel portion 3*a* higher than a state immediately after writing the high-level video signal VIDEO1 in the pixel portion 3*a* by supplying the high-level output signals SC1-1 SC1-3 (high voltage VSCH) to the second electrode 37*a* of the subsidiary capacitor 33 of the pixel portion 3*a* after writing the video signal VIDEO1. Further, the liquid crystal display can render the pixel voltage Vp2 of the pixel portion 3*b* lower than a state immediately after writing the low-level video signal VIDEO2 in the pixel portion 3*b* by supplying the low-level output signals SC2-1 to SC2-3 (low voltage VSCL) to the second electrode 37*b* of the subsidiary capacitor 33 of the pixel portion 3*b* after writing the video signal VIDEO2. Thus, the voltages of the video signals VIDEO1 and VIDEO2 may not be increased, whereby the liquid crystal display can reduce power consumption.

According to the first embodiment, the liquid crystal display can easily perform dot inversion driving by adjacently arranging the pixel portions 3*a* and 3*b*. When the liquid crystal display performs dot inversion driving, no flickering linearly takes place dissimilarly to a case of performing line inversion driving, whereby flickering can be easily rendered hard to visually recognize.

According to the first embodiment, the gate line driving circuit 6 is constituted of the plurality of transistors of the same conductive type (n type) while the signal supply circuit 7 is constituted of the plurality of transistors of the same conductive type (n type) as those constituting the gate line driving circuit 6, whereby it is possible to inhibit the numbers of ion implantation steps and ion implantation masks from increase when forming the plurality of transistors constituting the gate line driving circuit 6 and the plurality of transistors constituting the signal supply circuit 7 respectively. Thus, complication of the manufacturing process as well as increase of the manufacturing cost can be suppressed.

According to the first embodiment, the liquid crystal display provided with the pairs of subsidiary capacitance lines (SC1-1 to SC1-3 and SC2-1 to SC2-3) stage by stage in correspondence to the plurality of stages of gate lines (G1 to G3) respectively with the signal supply circuit portions 72 to 74 connected to the plurality of pairs of subsidiary capacitance lines (SC1-1 to SC1-3 and SC2-1 to SC2-3) respectively can easily sequentially supply the high- and low-level signals (high and low voltages VSCH and VSCL) to the plurality of stages of pairs of subsidiary capacitance lines (SC1-1 to SC1-3 and SC2-1 to SC2-3) through the signal supply circuit portions 72 to 74 corresponding to the plurality of stages of gate lines (G1 to G3) after sequentially writing the video signals VIDEO1 and VIDEO2 in the pixel portions 3*a* and 3*b* corresponding to the plurality of stages of gate lines (G1 to G3). In this case, the liquid crystal display supplying the high- and low-levels (high and low voltages VSCH and VSCL) from a prescribed stage of signal supply circuit portion to the corresponding pair of subsidiary capacitance lines in response to an output signal supplied to a subsequent gate line thereby supplying the output signal to the subsequent gate line after supplying the output signal to the prescribed stage of gate line can easily supply the high- and low-level signals (high and low voltages VSCH and VSCL) to the pair of subsidiary capacitance lines corresponding to the prescribed stage of gate line after writing the video signals VIDEO1 and VIDEO2 in the pixel portions 3*a* and 3*b* arranged along the prescribed stage of gate line.

According to the first embodiment, the liquid crystal display having the signal supply circuit portions 71 to 74 including the signal switching circuit portions 71*d* to 74*d* for switching the high- and low-level signals (high and low voltages VSCH and VSCL) supplied to the pair of subsidiary capacitance lines respectively can easily switch the high- and low-level signals (high and low voltages VSCH and VSCL) supplied to the capacitors 33 of the pixel portions 3*a* and 3*b* respectively every frame period through the signal switching portions 72 to 74 when performing dot inversion driving of inverting the voltages of the video signals VIDEO1 and VIDEO2 written in the pixel electrodes 34 of the pixel portions 3*a* and 3*b* respectively with respect to the voltage of the common electrode (COM) 35 every frame period. Thus, the liquid crystal display can easily render the voltages of the pixel electrodes 34 of the pixel portions 3*a* and 3*b* higher or lower than the states immediately after writing the video signals VIDEO1 and VIDEO2 in the pixel portions 3*a* and 3*b* through the output signals SC1-1 to SC1-3 and SC2-1 to SC2-3 output from the pair of subsidiary capacitance lines respectively after writing the video signals VIDEO1 and VIDEO2.

According to the first embodiment, the liquid crystal display provided with the signal supply circuit portions 72 to 74 including the transistors NT61 having the sources connected to the subsidiary capacitance lines (SC1-1 to SC1-3) and the drains supplied with the high voltage VSCH, the transistors NT62 having the sources connected to the subsidiary capacitance lines (SC1-1 to SC1-3) and the drains supplied with the low voltage VSCL, the transistors NT63 having the sources connected to the subsidiary capacitance lines (SC2-1 to SC2-3) and the drains supplied with the high voltage VSCH and the transistors NT63 having the sources connected to the subsidiary capacitance lines (SC2-1 to SC2-3) and the drains supplied with the low voltage VSCL while controlling the ON-state periods of the transistors NT61 and NT64 and the transistors NT62 and NT63 not to overlap with each other can easily supply the high- and low-level signals (high and low voltages VSCH and VSCL) to the subsidiary capacitance lines (SC1-1 to SC1-3 and SC2-1 to SC2-3) respectively through the ON-state transistors NT61 and NT64 by turning on the transistors NT61 and NT64 when supplying the high- and low-level signals (high and low voltages VSCH and VSCL) to the subsidiary capacitance lines (SC1-1 to SC1-3 and SC2-1 to SC2-3) respectively. When supplying the low- and high-level signals (low and high voltages VSCL and VSCH) to the subsidiary capacitance lines (SC1-1 to SC1-3 and SC2-1 to SC2-3) respectively, on the other hand, the liquid crystal display can easily supply the low- and high-level signals (low and high voltages VSCL and VSCH) to the subsidiary capacitance lines (SC1-1 to SC1-3 and SC2-1 to SC2-3) respectively through the ON-state transistors NT62 and NT63 by turning on the transistors NT62 and NT63.

According to the first embodiment, the liquid crystal display supplying the output signals from the second signal generation circuits 71*b* to 74*b* to the gates of the transistors NT61 and NT64 of the signal switching circuit portions 71*d* to 74*d* while supplying the output signals from the third signal generation circuit portions 71*c* to 74*c* to the gates of the transistors NT62 and NT63 of the signal switching circuit portions 71*d* to 74*d* and controlling the output signals output from the second and third signal generation circuit portions 71*b* to 74*b* and 71*c* to 74*c* respectively so that the ON-state periods of the transistors NT61 and NT64 and the transistors NT62 and NT63 do not overlap with each other in the signal supply circuit portions 71 to 74 including the sequentially serially connected first, second and third signal supply circuit portions 71*a* to 74*a*, 71*b* to 74*b* and 71*c* to 74*c* can easily turn on only the transistors NT61 and NT64 when supplying the high- and low-level signals (high and low voltages VSCH and VSCL) to the subsidiary capacitance lines (SC1-1 to SC1-3 and SC2-1 to SC2-3) respectively. When supplying the low- and high-level signals (low and high voltages VSCL and VSCH) to the subsidiary capacitance lines (SC1-1 to SC1-3 and SC2-1 to SC2-3) respectively, on the other hand, the liquid crystal display can easily turn on only the transistors NT62 and NT63.

According to the first embodiment, the liquid crystal display having the transistor NT34 connected to be turned on in response to the clock signal XCKVSC for obtaining an ON-state period not overlapping with that of the transistor NT33 in the first signal generation circuit portion 71*a*, including the transistors NT31 to NT35, of the signal supply circuit portion 71 connected to the pair of dummy subsidiary capacitance lines (SC1-D and SC2-D) not to overlap the ON-state periods of the transistors NT33 and NT34 can inhibit a through current from flowing through the transistors NT33 an NT34. Further, the liquid crystal display connecting the transistors NT31 to NT34 to turn the transistors NT32 and NT31 on and off respectively when the transistor NT33 is in an ON-state not to overlap the ON-state periods of the transistors NT31 and NT32 can inhibit a through current from flowing through the transistors NT31 and NT32. The liquid crystal display can attain similar effects also in the second and third signal generation circuit portions 71*b* and 71*c* as well as the signal supply circuit portions 72 to 74.

Further, the liquid crystal display supplying the output signal from the node ND42 of the second signal generation circuit portion 71*b* to the gates of the transistors NT61 and NT64 of the signal switching circuit portion 71*d* while supplying the output signal from the node ND52 of the third signal generation circuit portion 71*c* to the gates of the transistors NT62 and NT63 of the signal switching circuit portion 71*d* respectively in the second and third signal generation circuit portions 71*b* and 71*c* including the transistors NT41 to NT45 and NT51 to NT55 respectively so that the voltages of the nodes ND42 and ND52 of the second and third signal generation circuit portions 71*b* and 71*c* do not simultaneously go high (low) can easily turn off the transistors NT62 and NT63 when the transistors NT61 and NT64 are in ON-states while turning off the transistors NT61 and NT64 when the transistors NT62 and NT63 are in ON-states in the signal switching circuit portion 71*d*. The liquid crystal display can attain similar effects also in the signal supply circuit portions 72 to 74.

According to the first embodiment, the liquid crystal display provided with the diode-connected transistor NT35 between the gate of the transistor NT31 and the transistor NT34 in the first signal generation circuit portion 71*a*, including the transistors NT31 to NT35, of the signal supply circuit portion 71 connected to the pair of dummy subsidiary capacitance lines (SC1-D and SC2-D) so that no current flows back between the gate of the transistor NT31 and the gate line (G1) can inhibit the gate voltage of the transistor NT31 from fluctuation when the transistor NT31 is in an ON-state. Thus, the liquid crystal display can reliably hold the transistor NT31 in an ON-state. Further, the liquid crystal display provided with the capacitor C31 connected between the gate and the source of the transistor NT31 can raise the gate voltage of the transistor NT31 following rise of the source voltage of the transistor NT31 in order to maintain the gate-to-source voltage of the transistor NT31 connected with the capacitor C31. Thus, the liquid crystal display can further reliably hold the transistor NT31 in an ON-state. In addition, the liquid crystal display provided with the transistor NT33 having electrically connected two gate electrodes can distribute a voltage applied to the transistor NT33 between the source and the drain corresponding to the gate electrodes respectively through the gate electrodes. In this case, the liquid crystal display, capable of reducing a voltage applied between the source and the drain corresponding to the gate electrodes of the transistor NT33 respectively, can suppress deterioration of characteristics resulting from application of a large voltage to the transistor NT33. The liquid crystal display can attain similar effects also in the second and third signal generation circuits 71*b* and 71*c* as well as the signal supply circuit portions 72 to 74.

According to the first embodiment, the liquid crystal display can more easily perform dot inversion driving by alternately switching the high- and low-level signals (high and low voltages VSCH and VSCL) supplied to the subsidiary capacitance lines (SC1-1 to SC1-3 and SC2-1 to SC2-3) respectively every frame period thereby inverting the voltages of the video signals VIDEO1 and VIDEO2 written in the pixel portions 3*a* and 3*b* with respect to the voltage of the common electrode (COM) every frame period.

Second Embodiment

Figure 7:
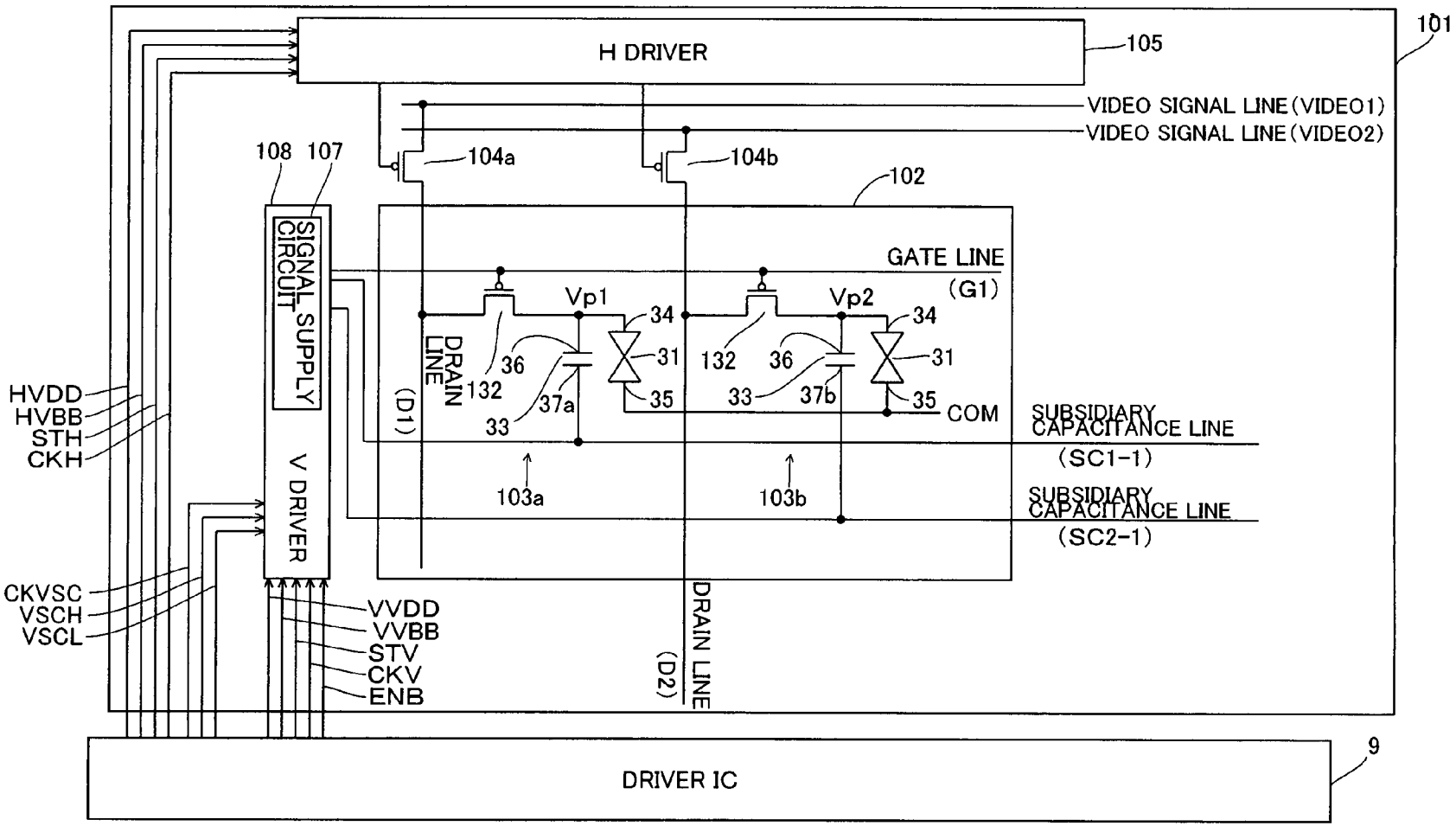
FIG. 7 is a plan view showing a liquid crystal display according to a second embodiment of the present invention.
Figure 8:
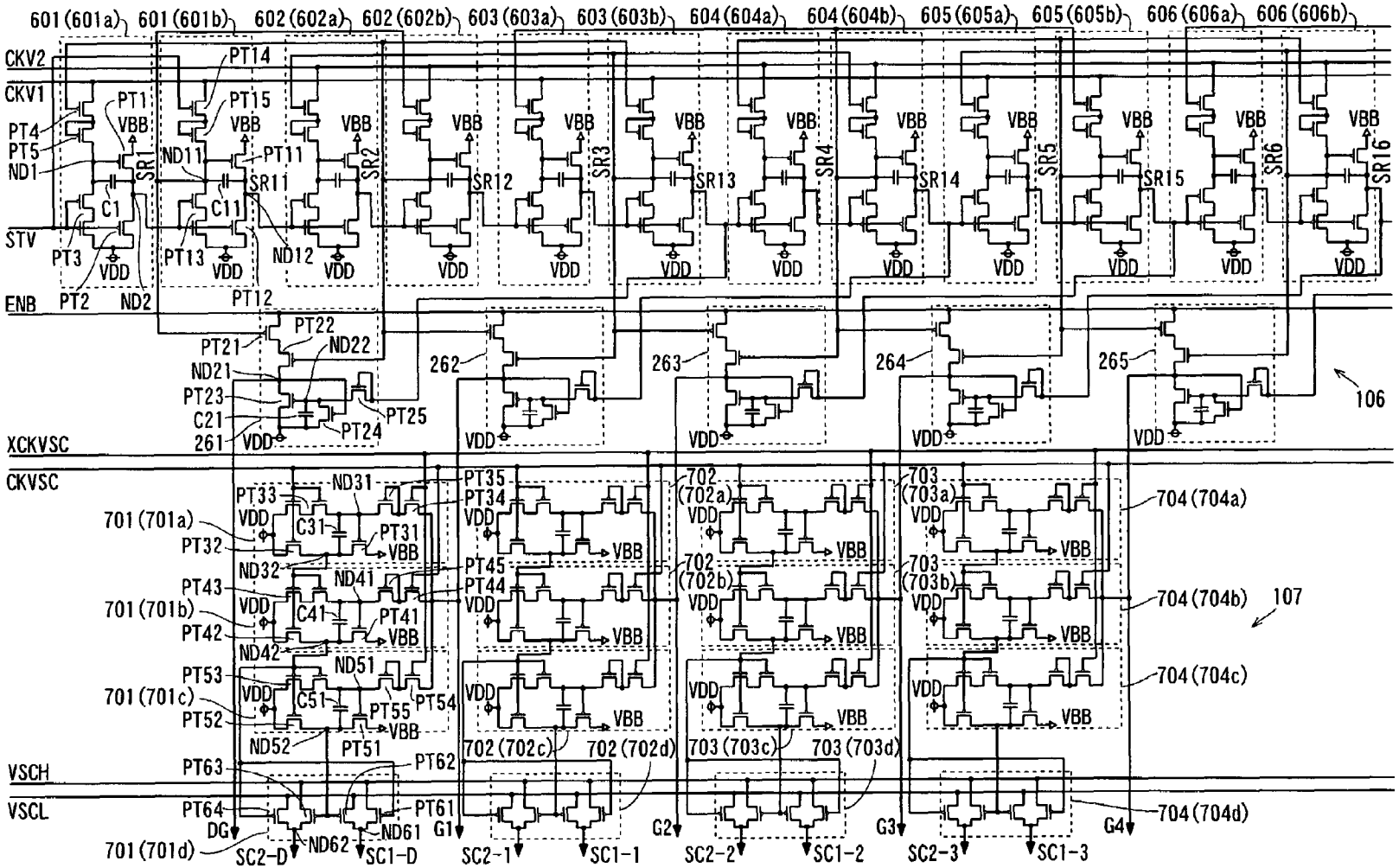
FIG. 8 is a circuit diagram in a V driver of the liquid crystal display according to the second embodiment shown in FIG. 7.

Referring to FIGS. 7 and 8, a V driver 108 similar to the V driver 8 according to the aforementioned first embodiment is constituted of p-channel transistors in a liquid crystal display according to a second embodiment of the present invention.

According to the second embodiment, pixel portions 103*a* and 103*b* are provided with p-channel transistors 132 (hereinafter referred to as transistors 132) in place of the n-channel transistors 32 according to the first embodiment shown in FIG. 1 respectively.

The remaining structure of a display portion 102 according to the second embodiment is similar to that of the display portion 2 according to the aforementioned first embodiment.

An H driver 105 formed by a plurality of p-channel transistors (not shown) is provided on a substrate 101, in place of the H driver 5 according to the first embodiment shown in FIG. 1. In place of the n-channel transistors (H switches) 4*a* and 4*b* according to the first embodiment shown in FIG. 1, further, p-channel transistors (H switches) 104*a* and 104*b* (hereinafter referred to as transistors 104*a* and 104*b*) are provided on the substrate 1.

According to the second embodiment, the V driver 108 including a gate line driving circuit 106 (see FIG. 8) formed by a plurality of p-channel transistors and a signal supply circuit 107 is provided in place of the V driver 8 according to the first embodiment shown in FIG. 1.

According to the second embodiment, transistors PT1 to PT5 and PT11 to PT15 constituting a first-stage shift register circuit portion 601 are connected to positions corresponding to the transistors NT1 to NT5 and NT11 to NT15 of the first-stage shift register circuit portion 61 according to the first embodiment shown in FIG. 3 respectively. However, the drains of the transistors PT1 and PT11 are connected to a lower voltage VBB, dissimilarly to the aforementioned first embodiment. Further, the sources of the transistors PT2, PT3, PT12 and PT13 are connected to a higher voltage VDD.

Second- to sixth-stage shift register circuit portions 602 to 606 have circuit structures similar to that of the aforementioned first-stage shift register circuit portion 601 respectively. In other words, the second- to sixth-stage shift register circuit portions 602 to 606 are constituted of first circuit portions 602*a* to 606*a* and second circuit portions 602*b* to 606*b* having circuit structures similar to those of the first and second circuit portions 601*a* and 601*b* of the first-stage shift register circuit portion 601 respectively.

According to the second embodiment, all of transistors PT21 to PT25 provided on a logic composition circuit portion 261 are constituted of TFTs formed by p-type MOS transistors.

Further, the transistors PT21 to PT25 constituting the logic composition circuit portion 261 connected to a dummy gate line (DG) are connected to positions corresponding to the transistors NT21 to NT25 of the logic composition circuit portion 161 connected to the dummy gate line (DG) according to the first embodiment shown in FIG. 3 respectively. However, the source of the transistor PT23 is connected to the higher voltage VDD, dissimilarly to the aforementioned first embodiment.

According to the second embodiment, all of transistors PT31 to PT35 provided on a first signal generation circuit portion 701*a* are constituted of TFTs formed by p-type MOS transistors.

Further, the transistors PT31 to PT35 constituting the first signal generation circuit portion 701*a* of a signal supply circuit portion 701 connected to dummy subsidiary capacitance lines (SC1-D and SC2-D) are connected to positions corresponding to the transistors NT31 to NT35 of the first signal generation circuit portion 71*a* of the signal supply circuit portion 71 connected to the dummy subsidiary capacitance lines (SC1-D and SC2-D) according to the first embodiment shown in FIG. 3 respectively. However, the drain of the transistor PT31 is connected to the lower voltage VBB, while the sources of the transistors PT32 and PT33 are connected to the higher voltage VDD.

According to the second embodiment, all of transistors PT41 to PT45 provided on a second signal generation circuit portion 701*b* are constituted of TFTs formed by p-type MOS transistors.

Further, the transistors PT41 to PT45 constituting the second signal generation circuit portion 701*b* of the signal supply circuit portion 701 connected to the dummy subsidiary capacitance lines (SC1-D and SC2-D) are connected to positions corresponding to the transistors NT41 to NT45 of the second signal generation circuit portion 71*b* of the signal supply circuit portion 71 connected to the dummy subsidiary capacitance lines (SC1-D and SC2-D) according to the first embodiment shown in FIG. 3 respectively. However, the drain of the transistor PT41 is connected to the lower voltage VBB, while the sources of the transistors PT42 and PT43 are connected to the positive voltage VDD.

According to the second embodiment, all of transistors PT51 to PT55 provided on a third signal generation circuit portion 701*c* are constituted of TFTs formed by p-type MOS transistors.

Further, the transistors PT51 to PT55 constituting the third signal generation circuit portion 701*c* of the signal supply circuit portion 701 connected to the dummy subsidiary capacitance lines (SC1-D and SC2-D) are connected to positions corresponding to the transistors NT51 to NT55 of the third signal generation circuit portion 71*c* of the signal supply circuit portion 71 connected to the dummy subsidiary capacitance lines (SC1-D and SC2-D) according to the first embodiment shown in FIG. 3 respectively. However, the drain of the transistor PT51 is connected to the lower voltage VBB, while the sources of the transistors PT52 and PT53 are connected to the positive voltage VDD.

According to the second embodiment, all of transistors PT61 to PT64 provided on a signal switching circuit portion 701*d* are constituted of TFTs formed by p-type MOS transistors.

Further, the transistors PT61 to PT64 constituting the signal switching circuit portion 701*d* of the signal supply circuit portion 701 connected to the dummy subsidiary capacitance lines (SC1-D and SC2-D) are connected to positions corresponding to the transistors NT61 to NT64 of the signal switching circuit portion 71*d* of the signal supply circuit portion 71 connected to the dummy subsidiary capacitance lines (SC1-D and SC2-D) according to the first embodiment shown in FIG. 3 respectively.

Figure 9:
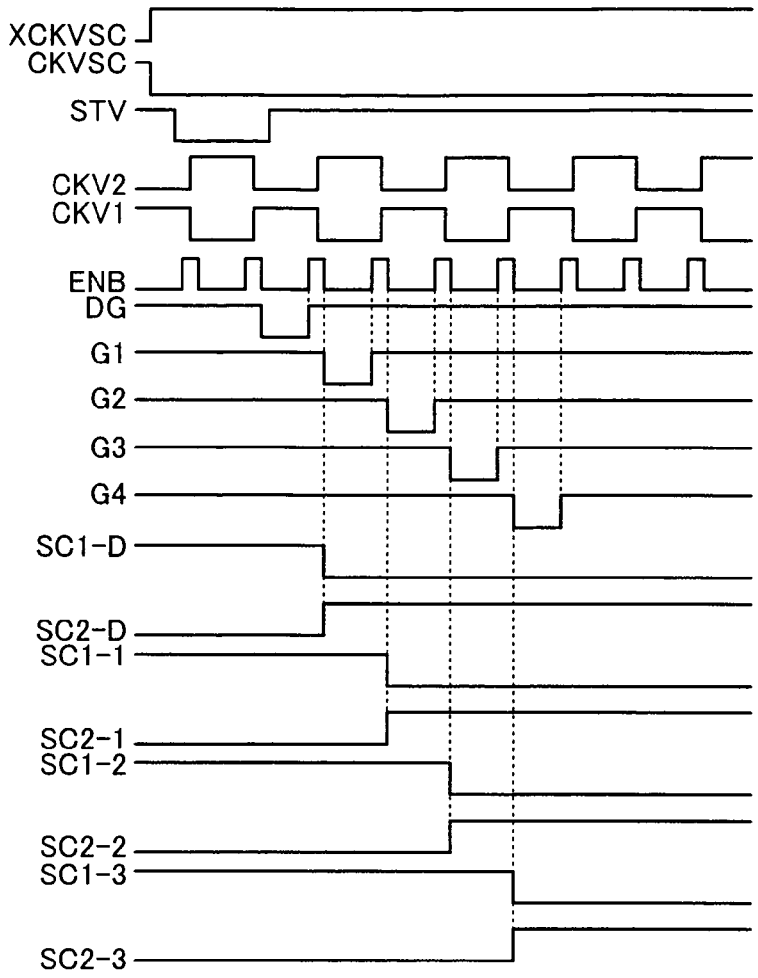
FIG. 9 is a voltage waveform diagram for illustrating operations of the V driver of the liquid crystal display according to the second embodiment of the present invention.
Figure 10:
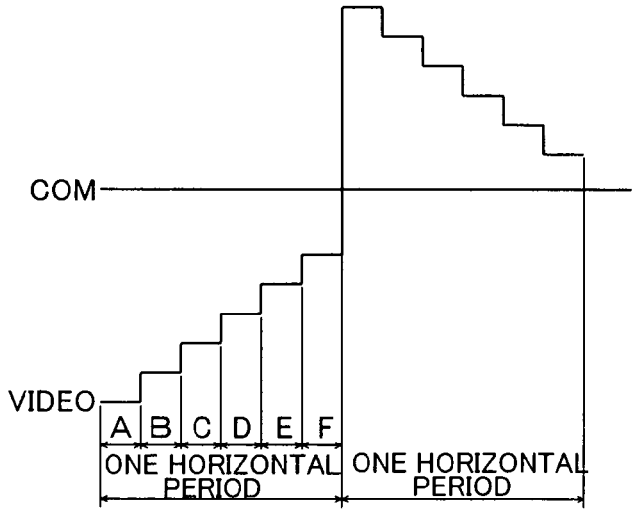
FIG.10 PRIOR ART
FIG. 10 is a waveform diagram showing a case of driving a liquid crystal display by a conventional line inversion driving method.
Figure 11:
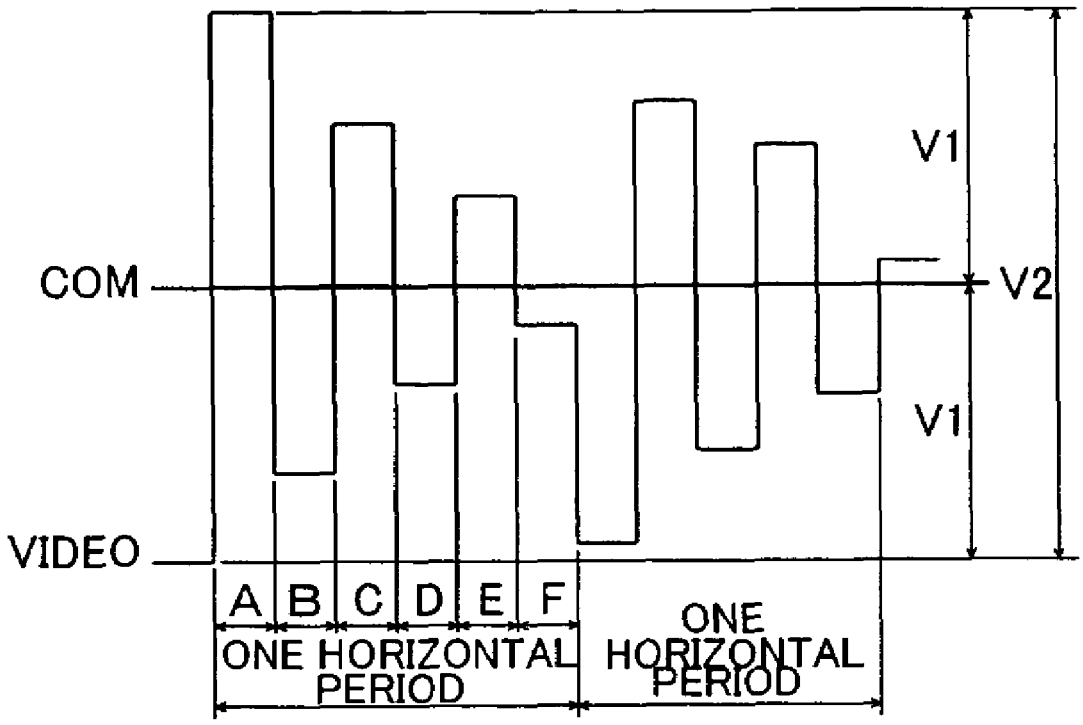
FIG.11 PRIOR ART
FIG. 11 is a waveform diagram showing a case of driving a liquid crystal display by a conventional dot inversion driving method.

FIG. 9 is a voltage waveform diagram for illustrating operations of the V driver 108 of the liquid crystal display according to the second embodiment of the present invention. The operations of the V driver 108 according to the second embodiment are now described with reference to FIGS. 8 and 9. The V driver 108 according to the second embodiment inputs signals having waveforms obtained by inverting the high and low levels of the start signal STV, the clock signals CKV1, CKV2 and CKVSC and the enable signal ENB according to the first embodiment shown in FIG. 4 as a start signal STV, clock signals CKV1, CKV2 and CKVSC and an enable signal ENB respectively. Thus, the logic composition circuit portion 261 and subsequent logic composition circuit portions 262 to 265 according to the second embodiment output signals having waveforms obtained by inverting the high and low levels of the output signals DG and G1 to G4 from the logic composition circuit portions 161 to 165 according to the aforementioned first embodiment respectively. Further, the signal supply circuit portion 701 and subsequent signal supply circuit portions 702 to 704 output signals obtained by inverting the high and low levels of the output signals SC1-D, S1-1 to S1-3, SC2-D and SC2-1 to S2-3 from the signal supply circuit portions 71 to 74 according to the aforementioned first embodiment respectively. The remaining operations of the V driver 108 according to the second embodiment are similar to those of the V driver 8 according to the aforementioned first embodiment.

The liquid crystal display according to the second embodiment can render flickering hard to visually recognize and reduce power consumption by performing dot inversion driving similarly to the aforementioned first embodiment, due to the aforementioned structure.

Further, the liquid crystal display according to the second embodiment provided with the gate line driving circuit 106 constituted of the plurality of transistors of the same conductive type (p type) and the signal supply circuit 107 constituted of the plurality of transistors of the same conductivity type (p type) as those constituting the gate line driving circuit 106 can inhibit the numbers of ion implantation steps and ion implantation masks from increase when forming the plurality of transistors constituting the gate line driving circuit 106 and those constituting the signal supply circuit 107, similarly to the first embodiment employing the n-type transistors. Thus, complication of the manufacturing process as well as increase of the manufacturing cost can be suppressed.

The remaining effects of the second embodiment are similar to those of the aforementioned first embodiment.

Although the present invention has been described and illustrated in detail, it is clearly understood that the same is by way of illustration and example only and is not to be taken by way of limitation, the spirit and scope of the present invention being limited only by the terms of the appended claims.

For example, while the signal supply circuit portions have the circuit structures shown in FIG. 3 or 8 in each of the aforementioned first and second embodiments, the present invention is not restricted to this but each signal supply circuit portion may simply be capable of supplying the high- and low-level signals to at least a pair of subsidiary capacitance lines respectively. Further, each signal supply circuit portion may simply be capable of alternately switching the high- and low-level signals supplied to at least a pair of subsidiary capacitance lines respectively every frame period.

While the liquid crystal display according to each of the aforementioned first and second embodiments performs dot inversion driving by adjacently arranging the first and second pixel portions (3*a* and 3*b* or 103*a* and 103*b*), the present invention is not restricted to this but the liquid crystal display may alternatively perform block inversion driving by constituting of one block of only a plurality of first pixel portions and constituting another block of only a plurality of second pixel portions while adjacently arranging these blocks.

While the liquid crystal display according to each of the aforementioned first and second embodiments sequentially turns on the n-channel transistors for driving the drain lines, the present invention is not restricted to this but the liquid crystal display may alternatively simultaneously turn on all n-channel transistors for driving the drain lines.

While the liquid crystal display supplies the high- and low-level signals to at least a pair of subsidiary capacitance lines corresponding to a prescribed stage of gate line at timing similar to that for writing the video signals in the pixel portions along the subsequent gate line in each of the aforementioned first and second embodiments, the present invention is not restricted to this but the liquid crystal display may alternatively supply prescribed signals to at least the pair of subsidiary capacitance lines corresponding to the prescribed stage of gate line at timing different from that for writing the video signals in the pixel portions along the subsequent gate line.

What is claimed is:

1. A display comprising:

a plurality of drain lines and a plurality of gate lines arranged to intersect with each other;

a first pixel portion and a second pixel portion each including subsidiary capacitors having first electrodes connected to pixel electrodes and second electrodes respectively;

a first subsidiary capacitance line connected to said second electrodes of said subsidiary capacitors of said first pixel portion and not connected to said second electrodes of said subsidiary capacitors of said second pixel portion and a second subsidiary capacitance line connected to said second electrodes of said subsidiary capacitors of said second pixel portion and not connected to said second electrodes of said subsidiary capacitors of said first pixel portion;

a gate line driving circuit including a shift register for sequentially driving said plurality of gate lines and consisting of only a plurality of transistors of the same conductive type; and a signal supply circuit supplying a first signal having a first voltage and a second signal having a second voltage to said first subsidiary capacitance line of said first pixel portion and said second subsidiary capacitance line of said second pixel portion respectively and including a plurality of signal supply circuit portions each formed by a plurality of transistors of the same conductive type as said transistors constituting said gate line driving circuit, wherein said signal supply circuit portions include:

a signal switching circuit portion for switching said first signal having said first voltage and said second signal having said second voltage supplied to said first subsidiary capacitance line and said second subsidiary capacitance line respectively, wherein said first pixel portion and said second pixel portion are arranged along the direction in which said gate lines extend, and wherein said first signal is provided to said first subsidiary capacitance line and said second signal is provided to said second subsidiary capacitance line in one frame period, and said second signal is provided to said first subsidiary capacitance line and said first signal is provided to said second subsidiary capacitance line in the next one frame period.

2. The display according to claim 1, wherein said signal supply circuit portions are provided in one-to-one correspondence to said plurality of gate lines respectively, and each said signal supply circuit portion sequentially supplies said first signal and said second signal to said first subsidiary capacitance line and said second subsidiary capacitance line of corresponding said gate line.

3. The display according to claim 1, wherein said signal supply circuit portions include:

a signal generation circuit portion for generating a signal driving said signal switching circuit portion.

4. The display according to claim 3, wherein said signal switching circuit portion includes a first transistor connected between said first subsidiary capacitance line and a first signal line supplied with said first signal having said first voltage, a second transistor connected between said first subsidiary capacitance line and a second signal line supplied with said second signal having said second voltage, a third transistor connected between said second subsidiary capacitance line and said first signal line and a fourth transistor connected between said second subsidiary capacitance line and said second signal line, said second transistor and said third transistor enter OFF-states and said first subsidiary capacitance line and said second subsidiary capacitance line are supplied with said first signal having said first voltage and said second signal having said second voltage through said first transistor and said fourth transistor respectively when said first transistor and said fourth transistor are in ON-states, and said first transistor and said fourth transistor enter OFF-states and said first subsidiary capacitance line and said second subsidiary capacitance line are supplied with said second signal having said second voltage and said first signal having said first voltage through said second transistor and said third transistor respectively when said second transistor and said third transistor are in ON-states.

5. The display according to claim 4, wherein said signal generation circuit portion includes a first signal generation circuit portion, a second signal generation circuit portion and a third signal generation circuit portion serially sequentially connected with each other, an output signal from said second signal generation circuit portion is input in the gates of said first transistor and said fourth transistor of said signal switching circuit portion while an output signal from said third signal generation circuit portion is input in the gates of said second transistor and said third transistor of said signal switching circuit portion, and said output signal from said second signal generation circuit portion is a signal obtaining an ON-state period not overlapping with ON-state periods of said second transistor and said third transistor of said signal switching circuit portion, and said output signal from said third signal generation circuit portion is a signal obtaining an ON-state period not overlapping with ON-state periods of said first transistor and said fourth transistor.

6. The display according to claim 5, wherein said first signal generation circuit portion, said second signal generation circuit portion and said third signal generation circuit portion have:

a fifth transistor connected to a third voltage and turned on in response to an output signal from said gate line driving circuit, a sixth transistor connected to a fourth voltage, a seventh transistor connected between the gate of said fifth transistor and said fourth voltage and an eighth transistor connected between the gate of said fifth transistor and said gate line supplied with said output signal from said gate line driving circuit and turned on in response to a clock signal obtaining an ON-state period not overlapping with an ON-state period of said seventh transistor thereby supplying said output signal from said gate line driving circuit to the gate of said fifth transistor.

7. The display according to claim 6, wherein said seventh transistor has a function of turning off said fifth transistor when said sixth transistor is in an ON-state.

8. The display according to claim 6, wherein a diode is connected between the gate of said fifth transistor and said eighth transistor.

9. The display according to claim 6, wherein a capacitor is connected between the gate and the source of said fifth transistor.

10. The display according to claim 6, wherein said seventh transistor has two gate electrodes electrically connected with each other.

11. The display according to claim 1, wherein said signal supply circuit portions and said gate lines are provided in a plurality of stages, prescribed said signal supply circuit portion is arranged to correspond to prescribed said gate line, and said prescribed signal supply circuit portion outputs said first signal and said second signal in response to an output signal supplied to said gate line subsequent to said prescribed gate line.

12. The display according to claim 1, wherein said first pixel portion and said second pixel portion are adjacently arranged.

13. The display according to claim 1, wherein said signal supply circuit portions supply said first signal and said second signal to said first subsidiary capacitance line and said second subsidiary capacitance line respectively after writing a video signal in all said pixel portions arranged along at least one said gate line.

14. The display according to claim 1, wherein said signal supply circuit portions alternately switch said first signal and said second signal supplied to said first subsidiary capacitance line and said second subsidiary capacitance line respectively every frame period for completely writing a video signal in all said pixel portions.

15. The display according to claim 1, wherein said first pixel portion and said second pixel portion are adjacently arranged, and a video signal supplied to said first electrodes of said first pixel portion and said second pixel portion has a waveform exhibiting inverted black and white voltages.

16. The display according to claim 1, wherein a first block constituted of only a plurality of said first pixel portions and a second block constituted of only a plurality of said second pixel portions are adjacently arranged, and a video signal supplied to said plurality of first pixel portions constituting said first block and said plurality of second pixel portions constituting said second block has a waveform exhibiting inverted black and white voltages.

* * * * *